US009919195B2

(12) United States Patent
Skiver

(10) Patent No.: US 9,919,195 B2
(45) Date of Patent: Mar. 20, 2018

(54) SHORT GAME GOLF TRAINER SYSTEM

(71) Applicant: Dutch Skiver, Maricopa, AZ (US)

(72) Inventor: Dutch Skiver, Maricopa, AZ (US)

( * ) Notice: Subject to any disclaimer, the term of this patent is extended or adjusted under 35 U.S.C. 154(b) by 0 days.

(21) Appl. No.: 15/414,871

(22) Filed: Jan. 25, 2017

(65) Prior Publication Data

US 2017/0216700 A1 Aug. 3, 2017

Related U.S. Application Data

(60) Provisional application No. 62/290,412, filed on Feb. 2, 2016.

(51) Int. Cl.
*A63B 69/36* (2006.01)

(52) U.S. Cl.
CPC ..... *A63B 69/3661* (2013.01); *A63B 69/36* (2013.01); *A63B 69/3676* (2013.01); *A63B 2208/0204* (2013.01)

(58) Field of Classification Search
USPC ..... 473/174, 227, 257, 258, 260, 261, 264, 473/266, 267, 268, 273
See application file for complete search history.

(56) References Cited

U.S. PATENT DOCUMENTS 1,677,261 A * 7/1928 Williams ..... A63B 69/36 33/227
3,246,898 A 4/1966 Shoaf, Jr.
3,857,570 A * 12/1974 Gutierrez ..... A63B 69/3676 473/264
3,953,033 A * 4/1976 Kelly ..... G10D 7/06 211/70.2
5,007,646 A 4/1991 Baber
5,503,395 A * 4/1996 Cook ..... A63B 69/3676 473/261
6,416,420 B1 * 7/2002 Stark ..... A63B 24/0003 473/257
6,746,339 B1 * 6/2004 Thibaudeau ..... A63B 69/3641 473/267
8,556,743 B2 * 10/2013 Forest ..... A63B 69/3676 473/261
2003/0190972 A1 * 10/2003 Townsend, II ..... A63B 69/3623 473/278

* cited by examiner

*Primary Examiner* — Nini Legesse
(74) *Attorney, Agent, or Firm* — Keith L. Jenkins, Registered Patent Attorney, LLC; Keith L. Jenkins

(57) ABSTRACT

A short game golf trainer system in three releasably coupled parts: a horizontal base, a vertical support, and a cantilever horizontal top plate. The base has anchoring features, such as holes for receiving spikes, for anchoring the base to a putting green. The support is preferably one piece of molded plastic. The top plate is generally an irregular hexagonal plate and may have an arcuate front side. When assembled, the top plate is cantilevered from the support. The top plate has a viewing port located nearer the front side than the rear, but spaced apart from the front side by more than half of a golf ball diameter. The viewing port has a diameter less than a golf ball diameter. Top plates may be made in different lengths: longer for putting and shorter for chipping and pitching. Supports may be made in different heights: shorter for putting and higher for chipping and pitching.

20 Claims, 20 Drawing Sheets

SHORT GAME GOLF TRAINER SYSTEM

RELATED APPLICATIONS

This application claims the benefit of U.S. provisional patent application Ser. No. 62/290,412 filed Feb. 2, 2016 by the same inventor.

FIELD OF ART

The present invention relates to a device for assisting the training of golfers to putt, chip, pitch, and make shots from a bunker (sand trap). The present invention more particularly relates to a cantilevered panel with a view hole that focuses the vision of the golfer on a top center portion of the golf ball during putting, chipping, pitching, or bunker shooting.

BACKGROUND OF THE INVENTION

Putting is a crucial skill in the game of golf and many devices intended to assist golf instructors in training that skill have been offered to the golfing public, creating a desire for an efficient and effective short game golf trainer system that can be used with or without professional assistance.

SUMMARY OF THE INVENTION

Briefly described, the invention includes releasable connectable pieces that can form a cantilevered panel with a view hole that allows the golfer to view only a portion the golf ball on the putting or other golf ball supporting surface beneath the cantilevered panel. The cantilevered panel is supported by a support which, in turn, is supported on a base. The base has anchoring features for securing the base on the putting green or other surface, such as apertures for receiving anchors, such as golf tees, that can be used to secure the base to the ground. The cantilevered panel is preferably an irregular hexagon shape and may have an arcuate front side. The short game golf trainer system creates an environment which controls, promotes, and enhances the movement of the golf club, thereby producing the proper motion of the stroke. The short game golf trainer system trains the golfer's balance, vision, head stability, swing, rotation, and angle and height of the stroke. Accordingly, a golfer can learn to putt, chip, pitch, or bunker shot by feel and can avoid overthinking the short game shot. A shorter cantilevered panel with a taller support is used for training chipping, pitching, and bunker shooting while a longer cantilevered panel and a shorter support is used for training putting.

In one embodiment, the invention provides a short game golf trainer system including: a base; a support adapted to extend from the base; a top plate adapted to extend cantilevered from the support and having a front side distal from the support; a viewing port in the top plate that is distal from the support; is laterally centered on the top plate; has a center that is spaced apart from the front side by more than one-half the width of a golf ball; has a diameter that is less than the diameter of a golf ball. That short game golf trainer system, including a first releasable coupling portion between the base and the support. That short game golf trainer system, including a second releasable coupling portion between the support and the top plate. That short game golf trainer system, where the top plate includes; an irregular hexagonal shape; and a first portion of a second releasable coupling portion. That short game golf trainer system, including visible alignment features that are: either on or in the cantilevered top plate; and are aligned parallel to a rear side of said top plate on a centerline through said viewing port. That short game golf trainer system, where the alignment features include at least one of: a plurality of arrow-shaped designs on a top surface of the cantilevered top plate; and a plurality of golf ball sockets formed in the cantilevered top plate. That short game golf trainer system, where the base includes a flat plate having a plurality of an anchoring features. That short game golf trainer system where the base includes: an arcuate front side; an arcuate rear side; first and second opposed semicircular ends; and a first portion of a first releasable coupling portion. That short game golf trainer system, where the support includes: a bottom support plate adapted to be a second portion of a first releasable coupling portion; a pillar extending from the bottom support plate; and a top support plate extending from the pillar and adapted to be a second portion of a second releasable coupling portion. That short game golf trainer system, where the support includes one piece of molded plastic. That short game golf trainer system, where the support includes one of: a cylindrical pillar and circular top and bottom support plates; a pillar with a plurality of axially aligned, radially extending wings having curved portions between the wings; and a pillar with a plurality of axially aligned, radially extending wings having no curved portions between the wings. That short game golf trainer system, including a short game golf trainer system kit, further including: a base; a first support having a first height; a second support having a second height that is not the first height; a first top plate having a first length; a second top plate having a second length that is not the first length.

In one embodiment, the invention provides a short game golf trainer system including: a base; a support adapted to extend from the base; a top plate: adapted to extend cantilevered from the support; and having five straight sides and an arcuate front side distal from the support; a viewing port in the cantilevered top plate that is circular, is distal from the support, is laterally centered on the top plate, has a center that is spaced apart from the arcuate front side by more than one-half the width of a golf ball, and has a diameter that is less than the diameter of such golf ball. That short game golf trainer system, including a first releasable coupling portion between the base and the support and a second releasable coupling portion between the support and the top plate. That short game golf trainer system, where the top plate includes; a first portion of the second releasable coupling portion and visible alignment features that are either on or in the cantilevered top plate and are aligned parallel to a rear side of said top plate on a centerline through said viewing port. That short game golf trainer system, where the alignment features include a plurality of arrow-shaped designs on a top surface of the cantilevered top plate and/or a plurality of golf ball sockets formed in the cantilevered top plate. That short game golf trainer system, where the base includes: a flat plate having a plurality of an anchoring features; an arcuate front side; an arcuate rear side; first and second opposed semicircular ends; and a first portion of the first releasable coupling portion. That short game golf trainer system, where the support includes: a bottom support plate adapted to be a second portion of a first releasable coupling portion; a pillar extending from the bottom support plate; and a top support plate extending from the pillar and adapted to be a second portion of a second releasable coupling portion; one piece of molded plastic; and where the support includes one of: a cylindrical pillar and circular top and bottom support plates; a pillar with a plurality of axially aligned, radially extending wings having curved portions between the wings; and a pillar with a plurality of axially aligned, radially extending wings having no curved portions between the wings. In one embodiment, the short game golf trainer system includes a base further including: a flat plate having a plurality of an anchoring features; an arcuate front side an arcuate rear side; first and second opposed semicircular ends; and a first portion of a first releasable coupling portion a support adapted to extend from the base; and further including: a bottom support plate adapted to be a second portion of the first releasable coupling portion; a pillar extending from the bottom support plate; and a top support plate extending from the pillar and adapted to be a second portion of a second releasable coupling portion; and one piece of molded plastic; a top plate adapted to extend cantilevered from the support; having five straight sides and an arcuate front side distal from the support; having a first portion of the second releasable coupling portion; having a viewing port in the cantilevered top plate that: is circular; is distal from the support; is laterally centered on the top plate; has a center that is spaced apart from the arcuate front side by more than one-half the width of a golf ball; and has a diameter that is less than the diameter of such golf ball; having visible alignment features that are: either on or in the cantilevered top plate; and are aligned parallel to a rear side of the top plate on a centerline through said viewing port. That short game golf trainer system, including a short game golf trainer system kit, further including: the base; a first support having a first height; a second support having a second height that is not the first height; a first top plate having a first length; a second top plate having a second length that is not the first length.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 16:
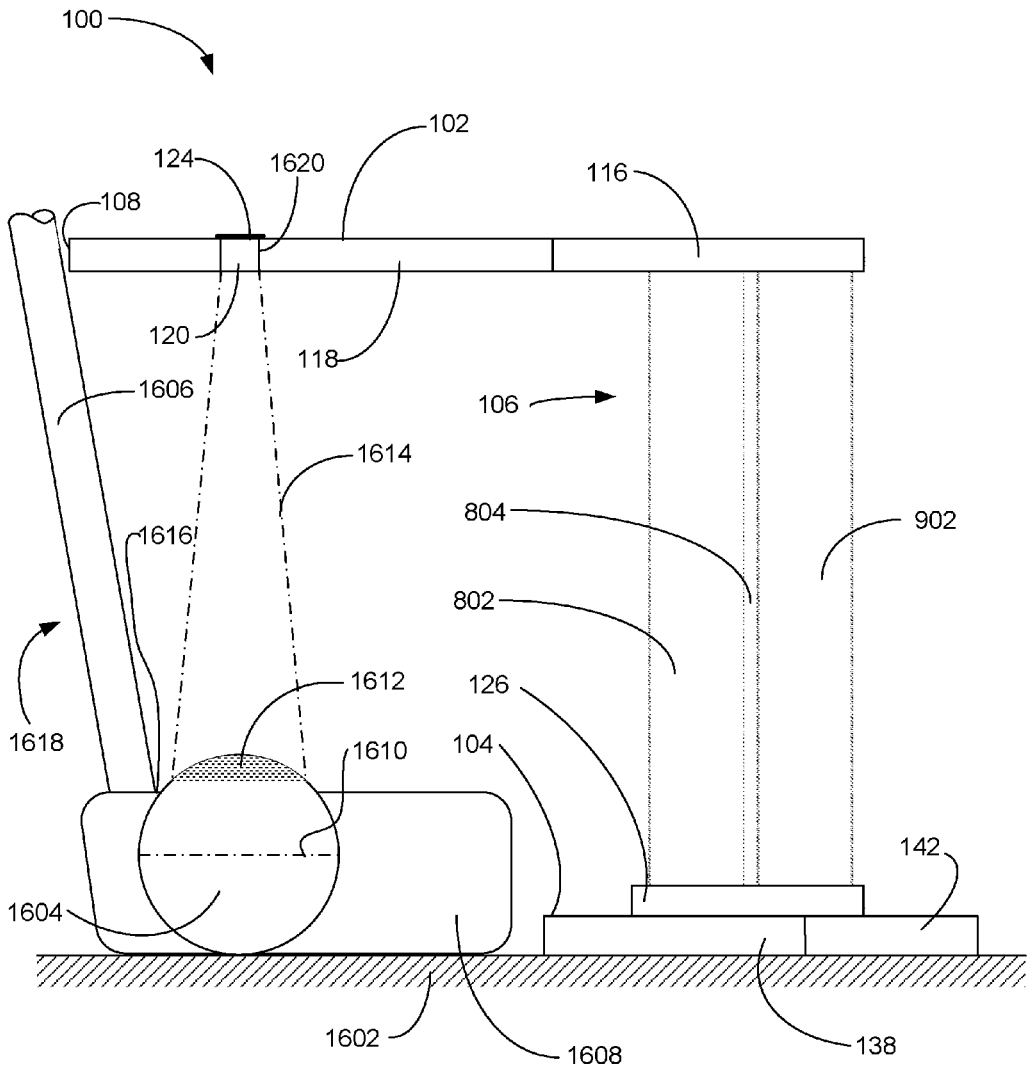
FIG. 16 is a side elevation view illustrating the exemplary embodiment of the short game golf trainer system of FIG. 1, according to a preferred embodiment of the present invention.

Herein, relational directions, such as left, right, top, bottom, front, and rear, are from the perspective of a user addressing the apparatus in its operational position, i.e. standing at the front of the apparatus looking down (see FIG. 16). The diameter of a golf ball is 1.68 inches per the American standard. The diameter of a British standard golf ball is 1.62 inches.

Figure 1:
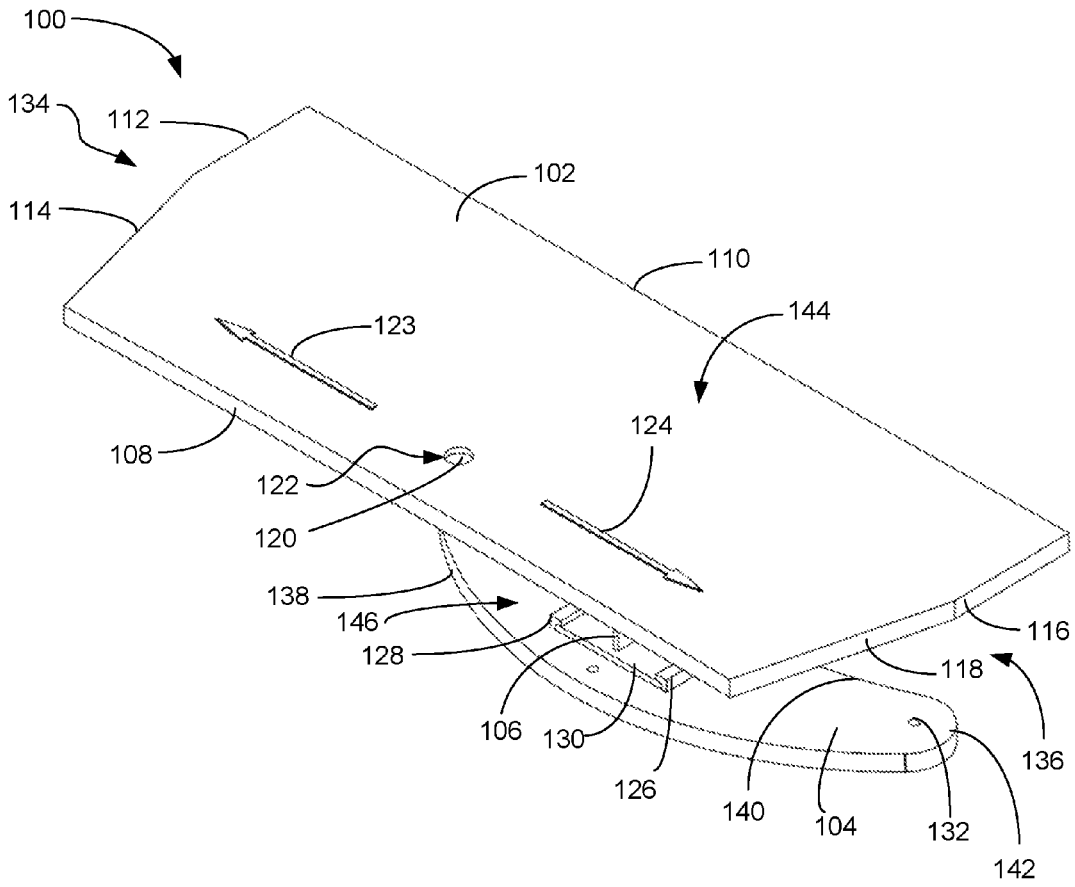
FIG. 1 is a perspective view illustrating an exemplary embodiment of a short game golf trainer system, according to a preferred embodiment of the present invention.

FIG. 1 is a perspective view illustrating an exemplary embodiment of a short game golf trainer system 100, according to the preferred embodiment of the present invention. Short game golf trainer system 100 is shown in a putting trainer configuration and includes an irregular hexagonal cantilevered top panel 102, a base 104, and a support 106 supporting the top panel 102 on the base 104. Top panel 102 has a slightly arcuate front side 108 and a straight rear side 110, which are approximately parallel. That is, a line between the end points of the slightly arcuate front side 108 is parallel to the rear side 110. The left end 134 (as viewed from the front) of top panel 102 has a first left side 112, perpendicular to rear side 110 and extending forward and a second left side 114 extending at angle to the front side 108. The right top panel end 136 (as viewed from the front) of top panel 102 has a first side 116, perpendicular to rear side 110, and extending forward to a second side 118 extending at angle to the front side 108. Right and left top panel ends 136 and 134 are preferably symmetrical. In an additional embodiment, front side 108 may be more arcuate or straight (see FIG. 25).

Top panel 102 has a viewing port 120 which is located such that it's the center of its circular edge 122 is everywhere more than one-half the width of a golf ball 1604 (see FIG. 16) away from the front side 108. Further in light of FIG. 16, viewing port 120 is sized such that, when a golf ball 1604 is resting on a putting green 1602 directly beneath the viewing port 120, a golfer can see only a portion 1612 of the golf ball 1604 and none of the putting green 1602. Putting green 1602 may be any surface used to practice putting, including artificial putting greens and other synthetic surfaces used for the purpose. The thickness 414 (see FIG. 4) of top panel 102 also plays a role in restricting the view through viewing port 120, forming a tube 1620, and is sized, in conjunction with the diameter of viewing port 120 to ensure that only a portion 1612 of the golf ball 1604, can be seen by the golfer when putting.

Alignment arrows 123 (for right handed golfers) and 124 (for left handed golfers) are raised above top panel top surface 144 and are aligned parallel to rear side 110 and along a axis through the center of viewing port 120. Alignment arrows 123 and 124 are merely examples of alignment features: in various other embodiments, various alignment features may be used. Top panel 102 may be made of any rigid material, but is preferably made of molded plastic of a type resistant to damage from sunlight and suitable for use in the high temperatures of a summer in the American Southwest. Top panel top surface 144 is preferably a diffuse reflector of sunlight. While the shape of top panel 102 is preferably as shown, substantial variation is within the scope of the invention, within the constraints that the top panel 102 be cantilevered, has a viewing port 120 with a center of its circular edge 122 that is everywhere more than one-half the diameter of a golf ball 1604 from the front side 108, and that the viewing port restricts the golfer's vision to see only a portion 1612 of the golf ball 1604 when the golf ball 1604 rests on the putting green 1602. In a particular embodiment, front side 108 may be beveled.

Base 104 is intended to rest on a putting green. Base 104 has an arcuate front base side 138, an arcuate rear base side 140, and rounded base ends 142. Base 104 has a plurality of anchoring features 132 (one of two visible labeled) for assisting in securing the base to the putting green 1602, exemplified in FIG. 1 as holes 132 for receiving nails, golf tees, or the like, to be pressed through anchoring features 132 and further pressed into the putting green 1602 to secure the base 104 to the putting green 1602. In additional embodiments, weights may be placed on base 104 in lieu of using penetrating devices. Base 104 has a user releasable coupling portion 146, exemplified in FIG. 1 as right and left channels 126 and 128, respectively, for forming slots 1102 and 1104 (see FIG. 11) into which the base support plate 130 of support 106 may be inserted for a friction fit during user assembly. Short game golf trainer system 100 is designed to be stored and transported in three pieces: top panel 102, base 104, and support 106. The front base side 138 of base 104 is rearward of top panel front side 108 by more than the length of a putter head 1608 (see FIG. 16) between the shaft juncture 1616 and the far end of the putter head 1608, thereby ensuring that the putter does not strike the base 104. Base 104 may be made of any suitable rigid material but is preferably made of molded plastic of a type resistant to damage from sunlight and high summer temperatures. Anchoring features 132 may be of any sort, including, without limitation, features to hold weights, rather than to assist in penetrating the putting green 1602. While the shape of base 104 is preferably as shown, substantial variation is within the scope of the invention, within the constraints that the front base side 138 does not extend to a point that it could be struck by the putter head 1608, that a user releasable coupling portion 146 is provided, and that anchoring features 132 for assisting in securing the base 104 to a putting green 1602 are provided.

Support 106 has a complimentary user releasable coupling portion at the bottom and top 130 and 702 (see FIG. 7) ends of support 106. Support 106 may be made of any suitable rigid material but is preferably made of molded plastic of a type resistant to damage from sunlight and high summer temperatures. In the illustrated embodiment, support 106 comprises four support panels 802, 804, 806, and 902 (see FIG. 8 and FIG. 9) at right angles to each other with base support plates 130 and top support plates 702 (see FIG. 7 and FIG. 8), exemplified here as rectangular but not so limited, on the aligned ends of the support panels 802, 804, 806, and 902. While the shape of base 104 is preferably as shown, substantial variation is within the scope of the invention, within the constraints that the support 106 maintains the top panel 102 in a cantilevered position, does not interfere with the motion of the putter, and provide a user releasable coupling portion 146. In a preferred embodiment, the base plates 103 may be circular. Without limitation, in various additional embodiments, support 106 may be a plurality of supports 106, a support of a completely different shape, and may include anchoring features. In a particular embodiment, the support 106 may have an adjustable height. Support 106 may be a single molded piece. In a particular embodiment, a circular base plate 103, four-panel support 106, and a rectangular top support plate 702 may be a single molded piece (see FIG. 21).

The overall size of the invention can be varied in additional embodiments. For non-limiting example, a shorter top panel 102, perhaps four inches long, may be used in an embodiment for training chipping and pitching golf shots (see FIG. 17 and FIGS. 31-33).

In operation, the short game golf trainer system 100 is configured for putting as shown in FIG. 1 and FIG. 16, and the base 104 is secured to a putting green 1602. A golf ball 1604 is placed on the putting green 1602 directly below viewing port 120, and the golfer addresses the ball with a putter 1618. Putter 1618 includes putter shaft 1606 and putter head 1608. Looking through the viewing port 120 and seeing only a portion 1612 of the ball and, peripherally, the front side 108 and the alignment arrows 123 and 124, the golfer swings the putter to propel the ball along the putting green in the desired direction. By keeping the golfer's vision focused on the ball 1604, the bad habit of a golfer taking his eye off the ball and looking down range just before making contact with the ball may be trained away.

Figure 2:
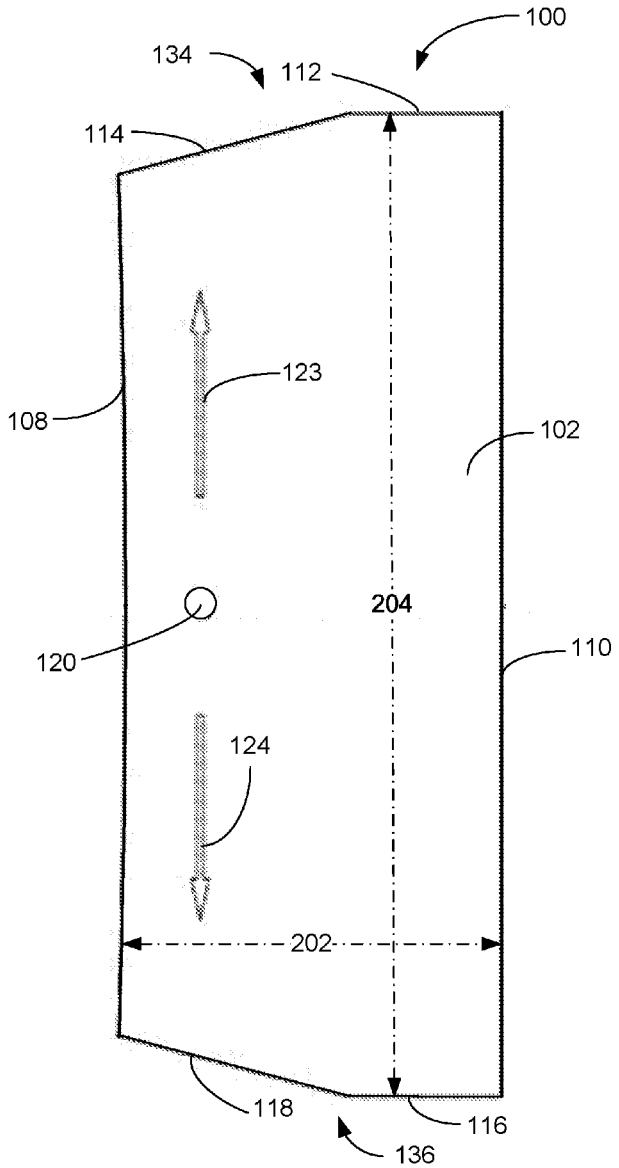
FIG. 2 is a top plan view illustrating the exemplary embodiment of a top panel of the short game golf trainer system of FIG. 1, according to a preferred embodiment of the present invention.

FIG. 2 is a top plan view illustrating the exemplary embodiment of a top panel 102 of the short game golf trainer system 100 of FIG. 1, according to a preferred embodiment of the present invention. The symmetry of left top panel end 134 and right top panel end 136 can be more clearly seen. Top panel 102 has a width 202 (for example, seven inches) and a length 204 (for example, eighteen inches). In a particular embodiment, rear side 110 need not be straight. The arrowheads shown on alignment arrows 123 and 124 are not limitations of the invention. In particular embodiments, different arrow heads may be used, or none at all. Preferably, top panel 102 is made in two parts.

Figure 3:
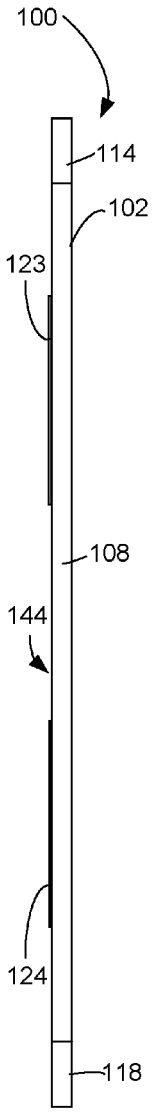
FIG. 3 is a front elevation view illustrating the exemplary embodiment of the top panel of the exemplary short game golf trainer system of FIG. 1, according to a preferred embodiment of the present invention.

FIG. 3 is a front elevation view illustrating the exemplary embodiment of the top panel 102 of the exemplary short game golf trainer system 100 of FIG. 1, according to a preferred embodiment of the present invention. The raised position of the alignment arrows 123 and 124 can be more clearly seen. In an additional embodiment, the alignment arrows 123 and 124 may be flush with the top panel top surface 144 of top panel 102. The extent to which the alignment arrows 123 and 124 are raised is not a limitation of the invention. One reason for raising them is to make them easy to paint with a paint or ink roller to provide a contrasting color to the top panel top surface 144 of top panel 102. Alignment arrows 123 and 124 are a non-limiting example of a visual alignment guide. For another non-limiting example of a visual alignment guide, see FIG. 18 and FIG. 19.

Figure 4:
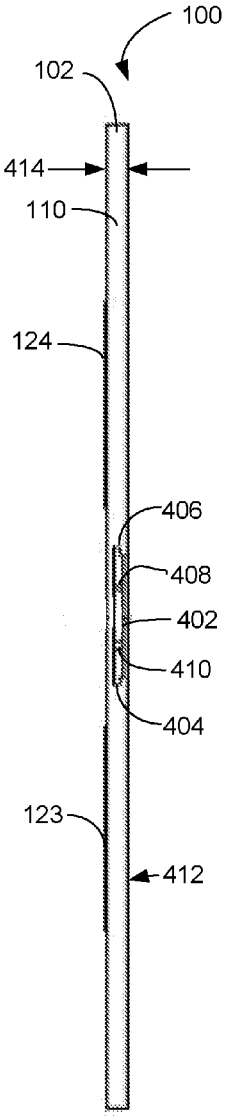
FIG. 4 is a rear elevation view illustrating the exemplary embodiment of the top panel of the short game golf trainer system of FIG. 1, according to a preferred embodiment of the present invention.

FIG. 4 is a rear elevation view illustrating the exemplary embodiment of the top panel 102 of the short game golf trainer system 100 of FIG. 1, according to a preferred embodiment of the present invention. Releasable coupling portion 402 receives the top releasable coupling portion 702 (see FIG. 7) of support 106. Slots 404 and 406 receive top support plate sides 814 and 812 (see FIG. 8), respectively. Ribbing 408 and 410 is also visible within the top panel 102. In additional embodiments, the thickness 414 is only critical around the viewing port 120 and the releasable coupling portion 402, other variations in thickness for additional embodiments are within the scope of the present invention. Preferably, top panel top surface 144 remains flat and bottom surface 412 of top panel 102 varies to provide thickness variation. Releasable coupling portion 402 is exemplified as a friction fit coupling, but that is not a limitation of the present invention.

Figure 5:
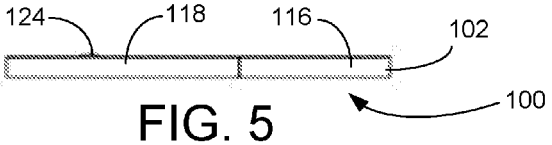
FIG. 5 is an end elevation view illustrating the exemplary embodiment of the top panel of the short game golf trainer system of FIG. 1, according to a preferred embodiment of the present invention.

FIG. 5 is an end elevation view illustrating the exemplary embodiment of the top panel 102 of the short game golf trainer system 100 of FIG. 1, according to a preferred embodiment of the present invention. In a particular embodiment, the juncture between first and second right sides 116 and 118 may be rounded (see FIG. 25).

Figure 6:
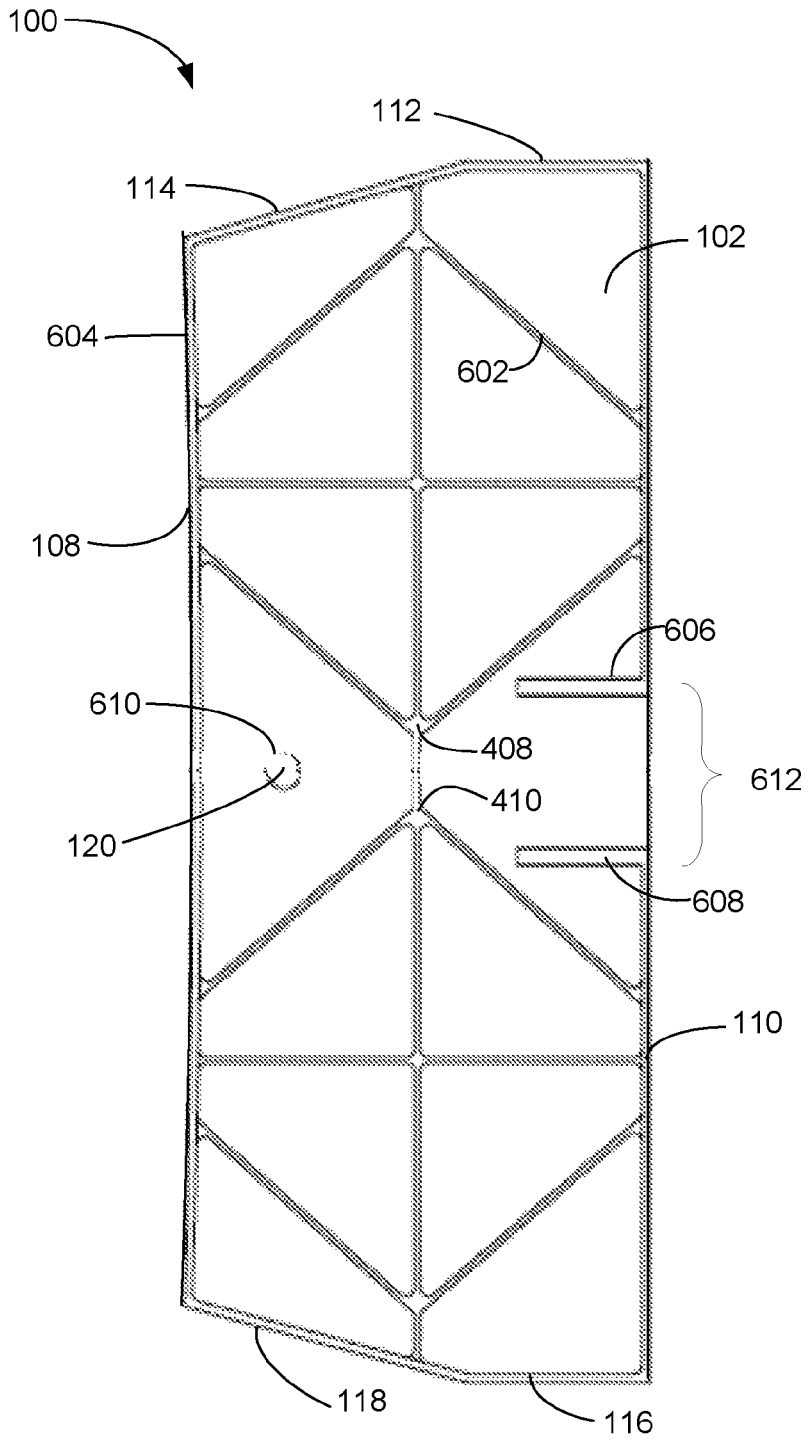
FIG. 6 is a bottom plan view illustrating the exemplary embodiment of the top panel of the short game golf trainer system of FIG. 1, according to a preferred embodiment of the present invention.

FIG. 6 is a bottom plan view illustrating the exemplary embodiment of the top panel 102 of the short game golf trainer system 100 of FIG. 1, according to a preferred embodiment of the present invention. Top panel 102 has cross ribbing 408, 409 and 602 and perimeter ribbing 604. The particular ribbing pattern shown is not a limitation of the invention, as various patterns may be used to increase the strength of top panel 102 while reducing the weight of top panel 102. The lighter top panel 102, the less force needed on the base 104 to maintain the cantilever. Channels 606 and 608 of releasable coupling portion 612 create slots 406 and 404, respectively. Viewing port 120 has a circumferential wall 610 below top panel 102. In a particular embodiment, top panel 102 may have a releasable coupling portion similar to releasable coupling portion 146 on the bottom surface 412 of top panel 102. The releasable coupling portion 612 is illustrated as a friction fit coupling, but that type of releasable coupling portion is not a limitation of the invention. For non-limiting example, support 106 may be a tube releasably fastened to the base 104 and the top panel 102 via a bolt through all three pieces, secured with a nut (see FIG. 20).

Figure 7:
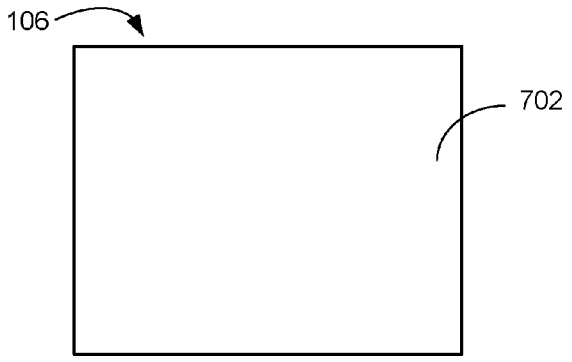
FIG. 7 is a top plan view illustrating the exemplary embodiment of the support of the short game golf trainer system of FIG. 1, according to a preferred embodiment of the present invention.

FIG. 7 is a top plan view illustrating the exemplary embodiment of the support 106 of the short game golf trainer system 100 of FIG. 1, according to a preferred embodiment of the present invention. Rectangular top support plate 702 is identical to bottom support plate 130. In various other embodiments, variations in shape and size of top support plate 702 are within the scope of the present invention.

Figure 8:
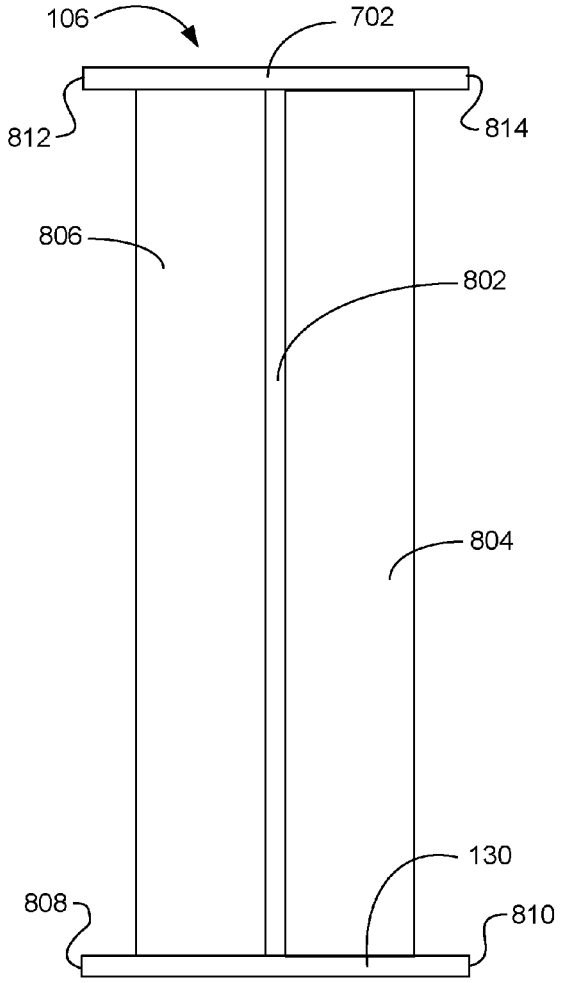
FIG. 8 is a front elevation view illustrating the exemplary embodiment of the support of the short game golf trainer system of FIG. 1, according to a preferred embodiment of the present invention.

FIG. 8 is a front elevation view illustrating the exemplary embodiment of the support 106 of the short game golf trainer system 100 of FIG. 1, according to a preferred embodiment of the present invention. Support panels 802, 804 and 806 are of similar size and shape and are oriented at right angles to each other. Preferably, support 106 is molded as a single piece. Edges 812 and 814 go into slots 406 and 404 to releasably couple support 106 to top panel 102. Base support edges 808 and 810 go into slots formed by channels 128 and 126, respectively, to releasably couple support 106 to base 104. Any variations in size and shape for support 106 that meet the functional requirements of providing support, releasably coupling to the base 104, and releasably coupling to the top panel 102, are within the scope of the invention.

Figure 9:
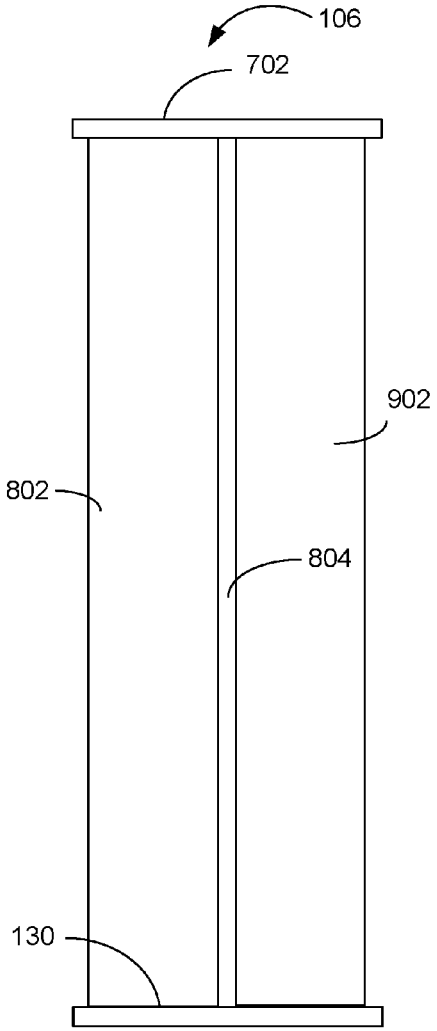
FIG. 9 is a side elevation view illustrating the exemplary embodiment of the support of the short game golf trainer system of FIG. 1, according to a preferred embodiment of the present invention.

FIG. 9 is a side elevation view illustrating the exemplary embodiment of the support 106 of the short game golf trainer system 100 of FIG. 1, according to a preferred embodiment of the present invention. Support panel 902 is visible in this view, which view is axially rotated ninety degrees from FIG. 8.

Figure 10:
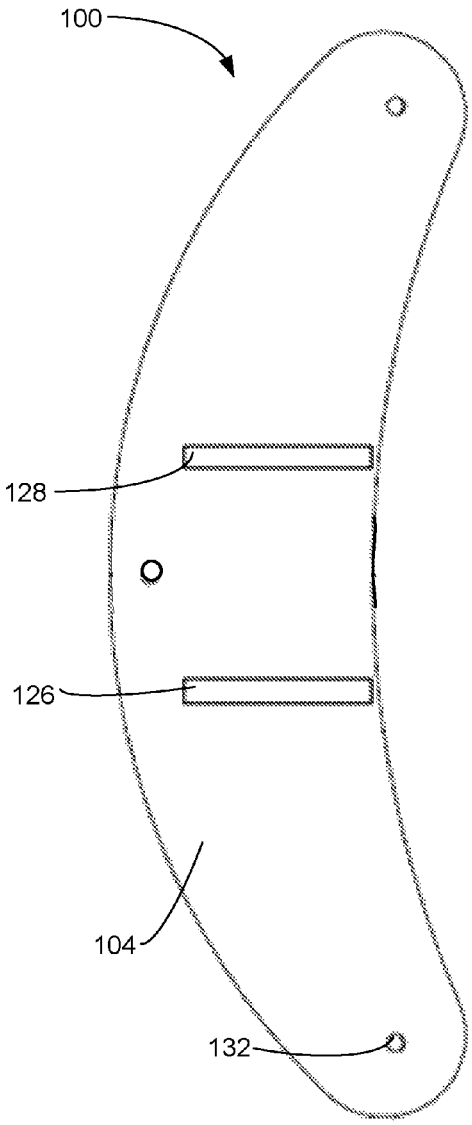
FIG. 10 is a top plan view illustrating the exemplary embodiment of the base of the short game golf trainer system of FIG. 1, according to a preferred embodiment of the present invention.

FIG. 10 is a top plan view illustrating the exemplary embodiment of the base 104 of the short game golf trainer system 100 of FIG. 1, according to a preferred embodiment of the present invention. The top side of base 104 can be most clearly seen in this view. The further rearward that anchoring features 132 (one of three labeled) are placed, the greater the leverage to maintain the cantilevered position of the top panel 102. Short game golf trainer system 100 is subject to some knocking around during operation, so it is preferred that the securing forces on the base be greater than the minimum force necessary to maintain the top panel 102 in cantilevered position. In a particular application, the base 104 may be installed in a reverse orientation.

Figure 11:
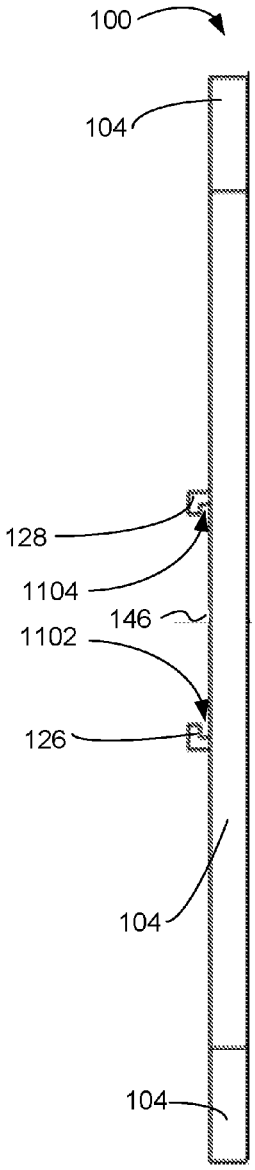
FIG. 11 is a rear elevation view illustrating the exemplary embodiment of the base of the short game golf trainer system of FIG. 1, according to a preferred embodiment of the present invention.

FIG. 11 is a rear elevation view illustrating the exemplary embodiment of the base 104 of the short game golf trainer system 100 of FIG. 1, according to a preferred embodiment of the present invention. Channels 126 and 128 of releasable coupling portion 146 create slots 1102 and 1104, respectively. Slots 1102 and 1104 receive base support sides 810 and 808, respectively, when the short game golf trainer system 100 is assembled. Slots 1102 and 1104 illustrate a friction fit coupling to bottom support panel 130, but that is not a limitation of the present invention.

Figure 12:
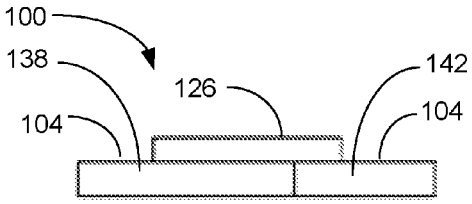
FIG. 12 is an end elevation view illustrating the exemplary embodiment of the base of the short game golf trainer system of FIG. 1, according to a preferred embodiment of the present invention.

FIG. 12 is an end elevation view illustrating the exemplary embodiment of the base 104 of the short game golf trainer system 100 of FIG. 1, according to a preferred embodiment of the present invention. The proportional height of the channels 126 and 128 of the releasable coupling portions 146 to the base 104 is not a limitation of the invention.

Figure 13:
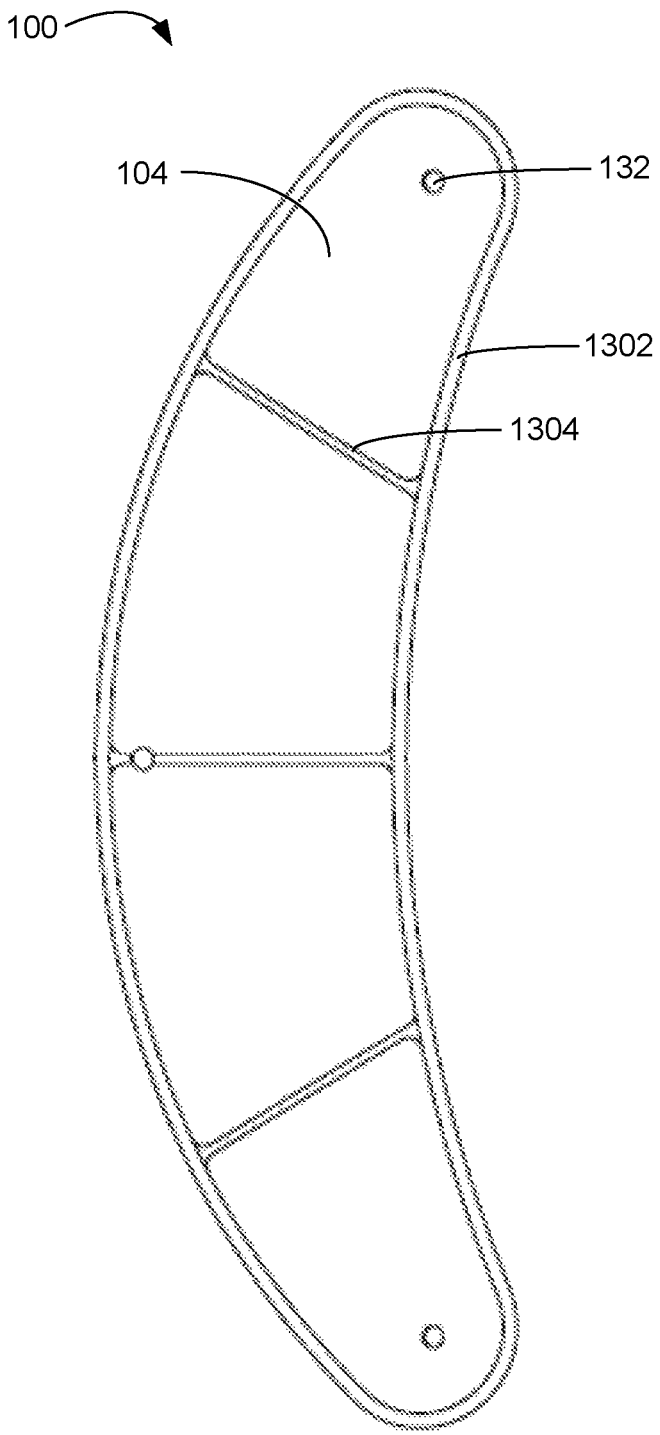
FIG. 13 is a bottom plan view illustrating the exemplary embodiment of the base of the short game golf trainer system of FIG. 1, according to a preferred embodiment of the present invention.

FIG. 13 is a bottom plan view illustrating the exemplary embodiment of the base 104 of the short game golf trainer system 100 of FIG. 1, according to a preferred embodiment of the present invention. Base 104 has a base perimeter rib 1302 and base cross ribbing 1304 (one of three labeled). The pattern and height of cross ribbing 1304 is not a limitation of the invention, as various patterns and heights may be used in a base 104 of this or other shapes in various additional embodiments.

Figure 14:
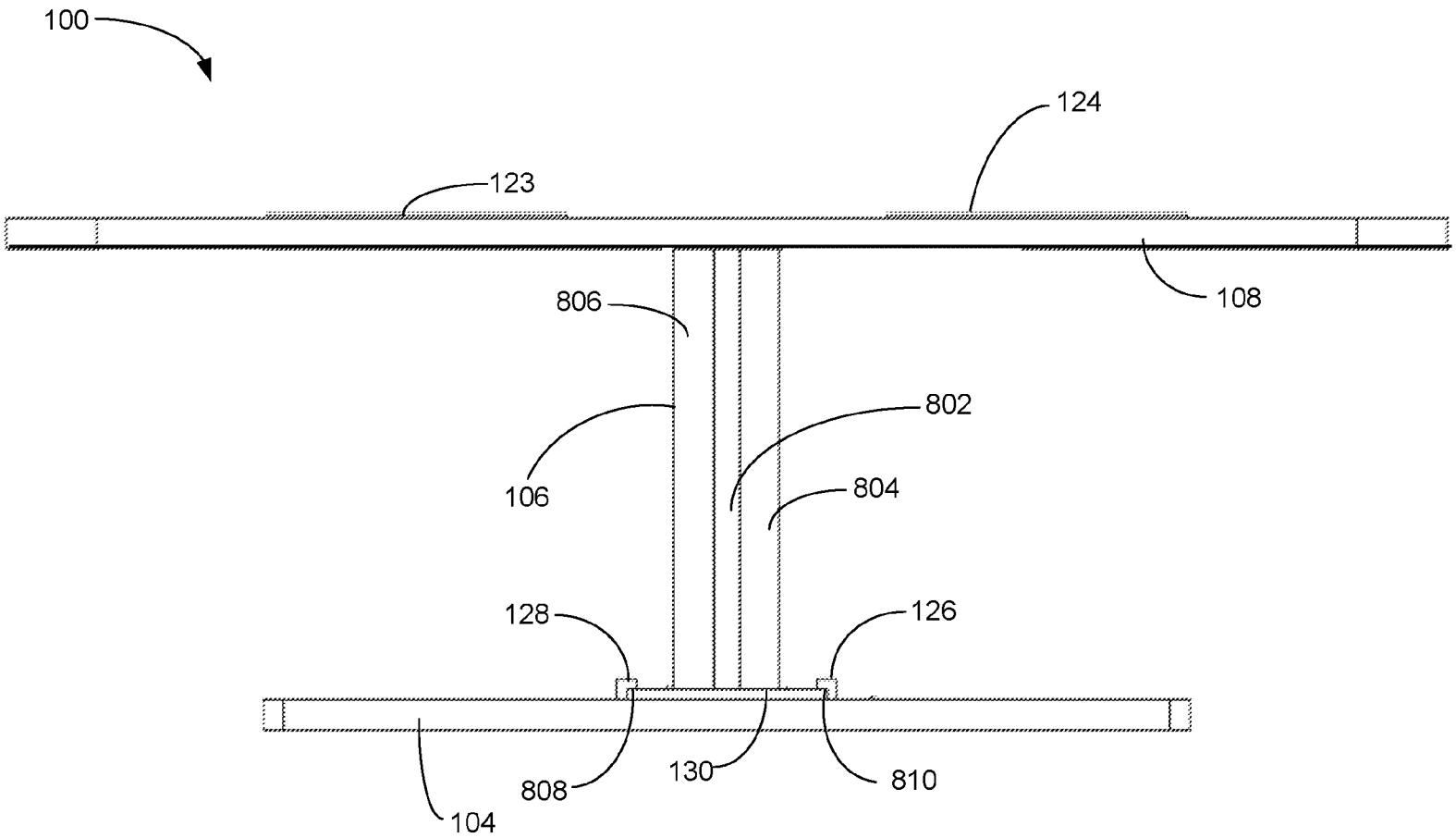
FIG. 14 is a front elevation view illustrating the exemplary embodiment of the short game golf trainer system of FIG. 1, according to a preferred embodiment of the present invention.

FIG. 14 is a front elevation view illustrating the exemplary embodiment of the short game golf trainer system 100 of FIG. 1, according to a preferred embodiment of the present invention. The short game golf trainer system 100 is shown in its assembled putting trainer configuration.

Figure 15:
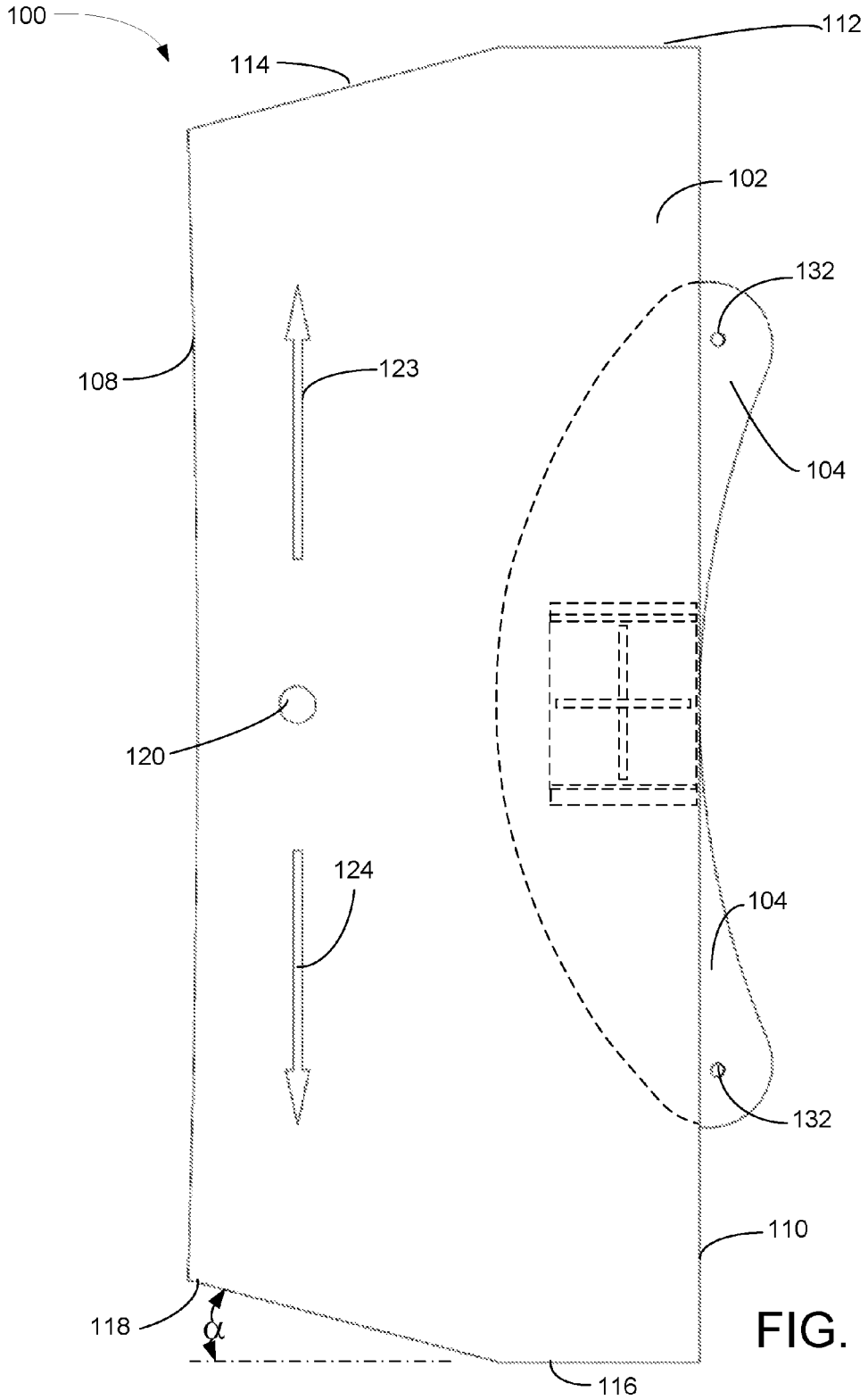
FIG. 15 is a top plan view illustrating the exemplary embodiment of the short game golf trainer system of FIG. 1, according to a preferred embodiment of the present invention.

FIG. 15 is a top plan view illustrating the exemplary embodiment of the short game golf trainer system 100 of FIG. 1, according to a preferred embodiment of the present invention. Some spatial relationships can be more clearly seen in this view. Angle $\alpha$ between first and second right sides 116 and 118 has the function of assisting the golfer in evaluating his putting stroke. If the club face is aligned with side 118 at the end of the stroke (or second left side 114 for a right-handed golfer), then the stroke was properly executed. Variations from proper club face angle may be evaluated for training purposes. The angle $\alpha$ is preferably fifteen degrees.

FIG. 16 is a side elevation view illustrating the exemplary embodiment of the short game golf trainer system of FIG. 1, according to a preferred embodiment of the present invention. Base 104 is resting on putting green 1602, as is golf ball 1604. Top panel 102 is cantilevered from the support 106 that is releasably coupled to base 104 and to top panel 102. Golf ball 1604 is centered below viewing port 120, such that a standing golfer, preparing to put the golf ball 1604, can see only the a limited portion 1612 of the golf ball 1604 through the viewing port 120, as indicated by sight lines 1614 (one of two labeled). The golfer should not be able to see any part of the equator 1610 of golf ball 1604. By not being able to see the equator 1610, the golfer cannot see the point of impact between the putter head 1608 and golf ball 1604, and so can avoid the instinctual flinching that occurs at impact and causes missed putts.

Putter head 1608 addresses golf ball 1604 and is actuated by the golfer using putter shaft 1606. In correct operation, putter shaft 1606 does not contact front side 108, as the front side 108 is not a guide. In correct operation, no part of the putter shaft 1606, putter head 1608 or the golf ball 1604 contacts any part of the short game golf trainer system 100. The width 202 of top panel 102 prevents a standing golfer from inserting putter head 1608 far enough under top panel 102 to impact base 104.

Figure 17:
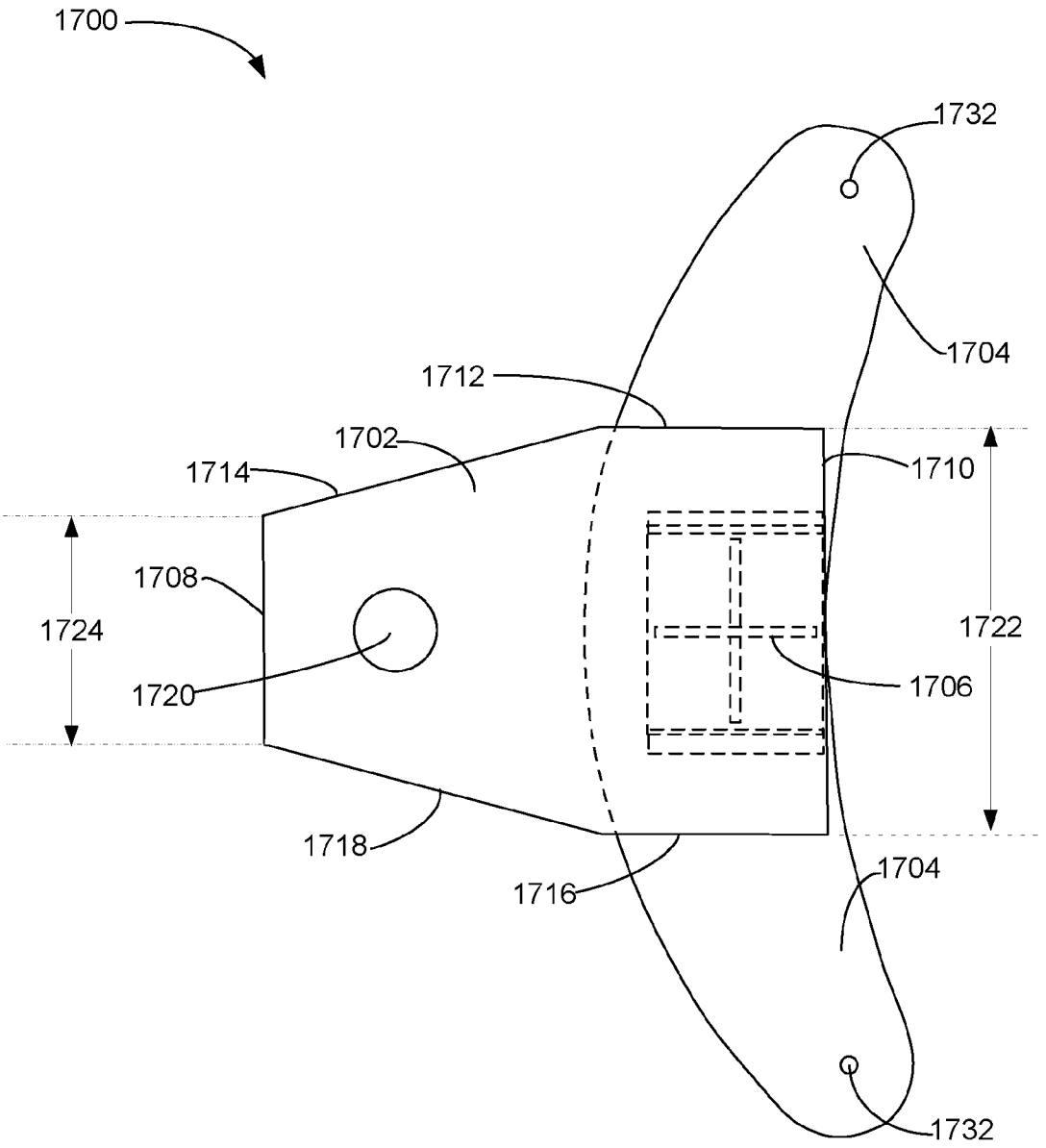
FIG. 17 is a top plan view illustrating a second exemplary embodiment of a short game golf trainer system, according to a preferred embodiment of the present invention.

FIG. 17 is a top plan view illustrating a second embodiment of a short game golf trainer system 1700, according to a preferred embodiment of the present invention. Short game golf trainer system 1700 is shown in a chipping, pitching and bunker shot trainer configuration and is similar to the putting trainer configuration of short game golf trainer system 100, except that the top panel 1702 is much shorter than top panel 102. Short game golf trainer system 1700 has a top panel 1702, a base 1704, and a support 1706 that releasably connects the top panel 1702. Top panel 1702 has a length 1722 that is approximately one-fifth (for example, three and one half inches) of the length 204 of top panel 102. Front side 1708 has a length 1724 that is greater than a golf ball diameter. Top panel 1702 has a viewing port 1720, centered more than one half of a golf ball diameter from front side 1708, for viewing a portion 1612 of a golf ball 1604, a rear side 1710, left and right rear sides 1712 and 1716 extending forward at right angles from rear side 1710, and left and right forward side sides 1714 and 1718 extending at an angle from left and right rear sides 1712 and 1716, respectively, to meet front side 1708. Anchoring features 1732 assist in securing the short game golf trainer system 1700 to the ground. Support 1706 and base 1704 are interchangeable with, and may be identical to, base 104 and support 106. In a particular embodiment, top panel 1702 is sold with top panel 102, support 106, and base 104 to provide a trainer for putting, chipping, pitching, and bunker shots. Short game golf trainer system 1700 enables the golfer to make a golf club swing of an ordinary arc while still having the sight and concentration training benefits of the putting trainer configuration of the short game golf trainer system 100.

Figure 18:
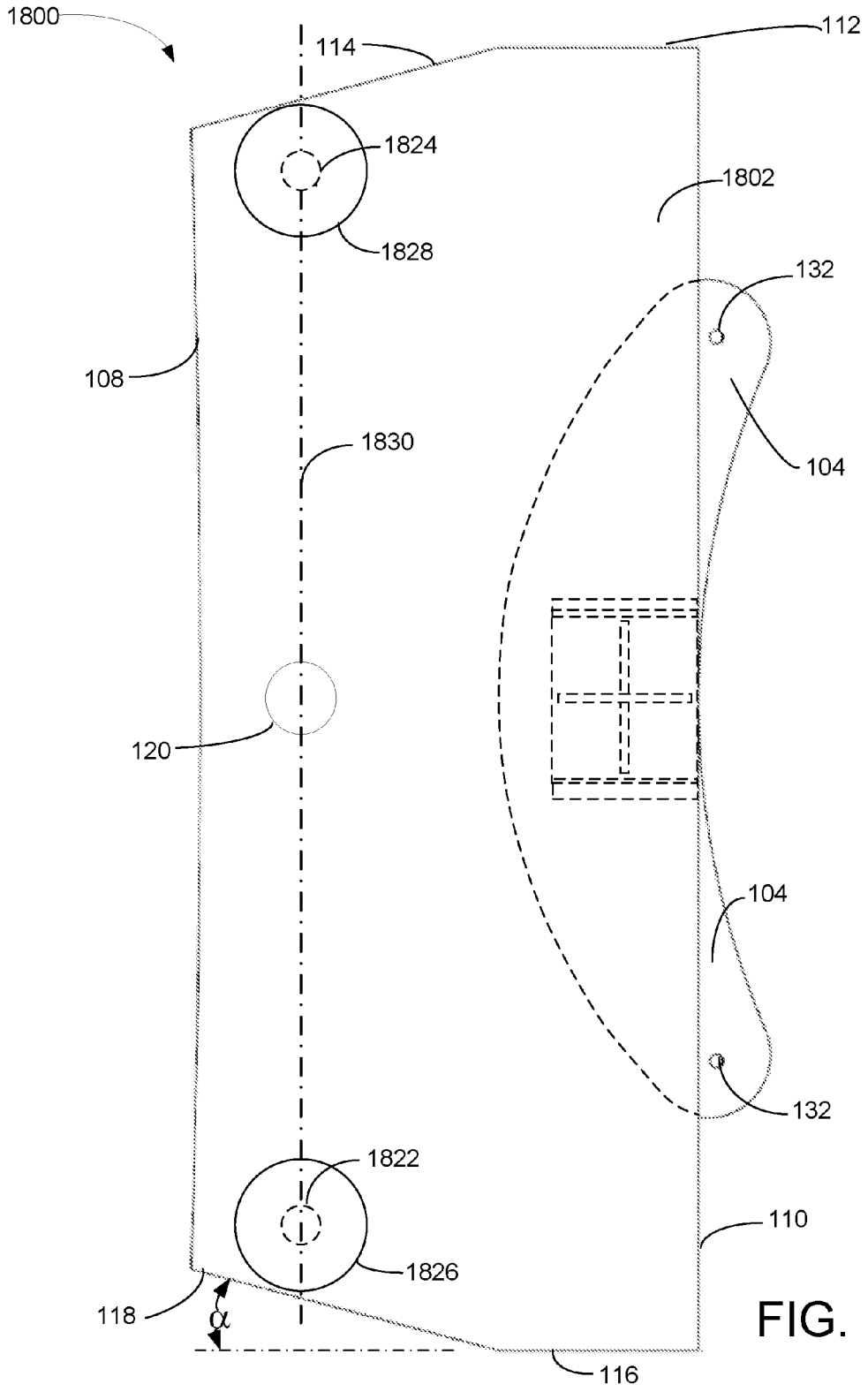
FIG. 18 is a top plan view illustrating a third exemplary embodiment of a short game golf trainer system, according to a preferred embodiment of the present invention.

FIG. 18 is a top plan view illustrating a third embodiment of a short game golf trainer system 1800, according to a preferred embodiment of the present invention. Short game golf trainer system 1800 is shown in a putting trainer configuration. Through holes 1822 and 1824 are aligned to a centerline 1830 through viewing port 120 in the preferred directions of the putt. Centerline 1830 is parallel to the rear side 110 of top plate 1802. Each through hole 1822 and 1824 serves as a golf ball socket for supporting golf balls 1826 and 1828, respectively. Viewed from a right-handed user's perspective, golf ball 1828 and viewing port 120 define a desired trajectory for the putted golf ball 1604. Viewed from a left-handed user's perspective, golf ball 1826 and viewing port 120 define a desired trajectory for the putted golf ball 1604. Through holes 1822 and 1824 are exemplary alignment features.

Figure 19:
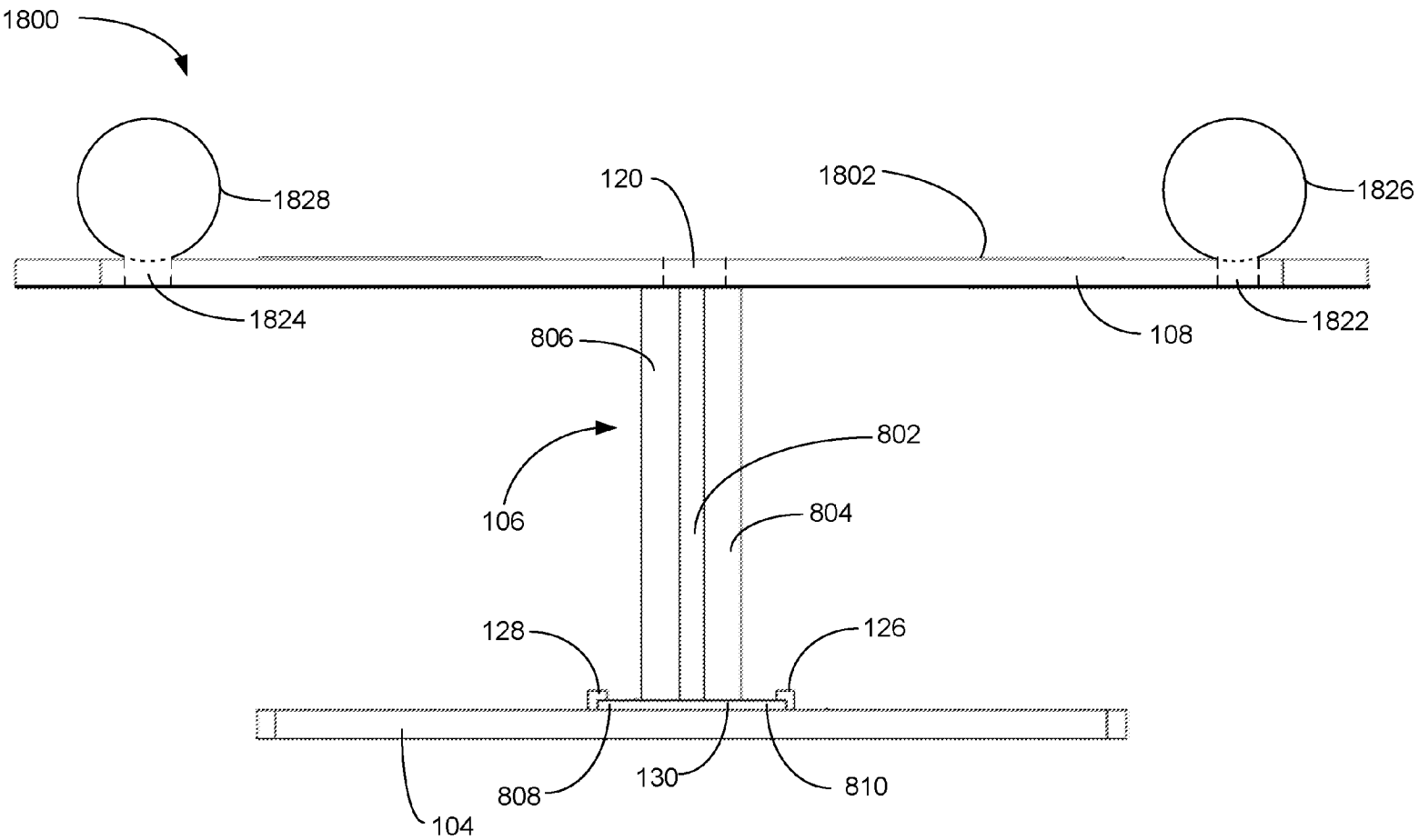
FIG. 19 is a front elevation view illustrating the third exemplary embodiment of the short game golf trainer system of FIG. 18, according to a preferred embodiment of the present invention.

FIG. 19 is a front elevation view illustrating the third embodiment of the short game golf trainer system 1800 of FIG. 18, according to a preferred embodiment of the present invention. Short game golf trainer system 1800 is shown in a putting trainer configuration. The location of golf balls 1826 and 1828 in through holes 1822 and 1824, respectively, can more easily be seen in this view. Through holes 1822 and 1824 are preferably made through top panel 102, as shown. For example, through holes 1822 and 1824 may be molded into top panel 102. In an additional embodiment, through holes 1822 and 1824 extend only deep enough to seat the golf balls 1826 and 1828, respectively.

Figure 20:
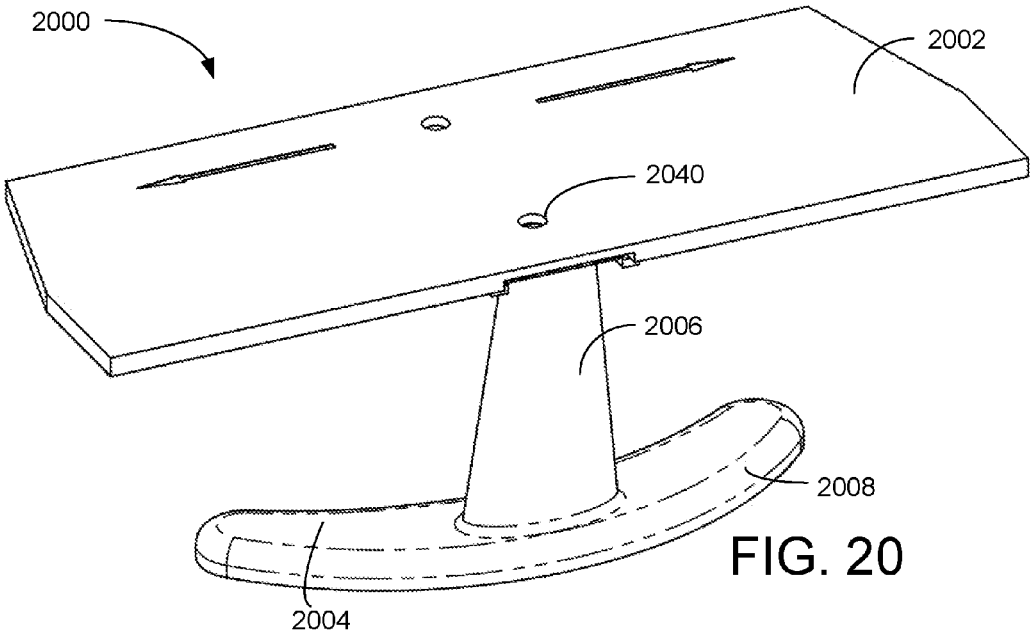
FIG. 20 is a top-rear perspective view illustrating an exemplary fourth embodiment of a short game golf trainer system, according to a preferred embodiment of the present invention.

FIG. 20 is a top-rear perspective view illustrating a an exemplary fourth embodiment of a short game golf trainer system 2000, according to a preferred embodiment of the present invention. Short game golf trainer system 2000 is shown in a putting trainer configuration. As mentioned above, support 106 may be a tube releasably fastened to the base 104 and the top panel 102 via a bolt through all three pieces, secured with a nut. Short game golf trainer system 2000 has a top plate 2002 that has, in additional to all the features of top plate 102, a fastener hole 2040 for assisting in fastening support 2006 to top plate 2002 and to base 2004. Support 2006 is adapted to use the same releasable coupling portion 402 as support 106 to top plate 102, plus a fastener. Support 2006 has an oval cross section and may, in a particular embodiment, be of one piece with the base 2004. Base 2004 has rounded sides 2008.

Figure 21:
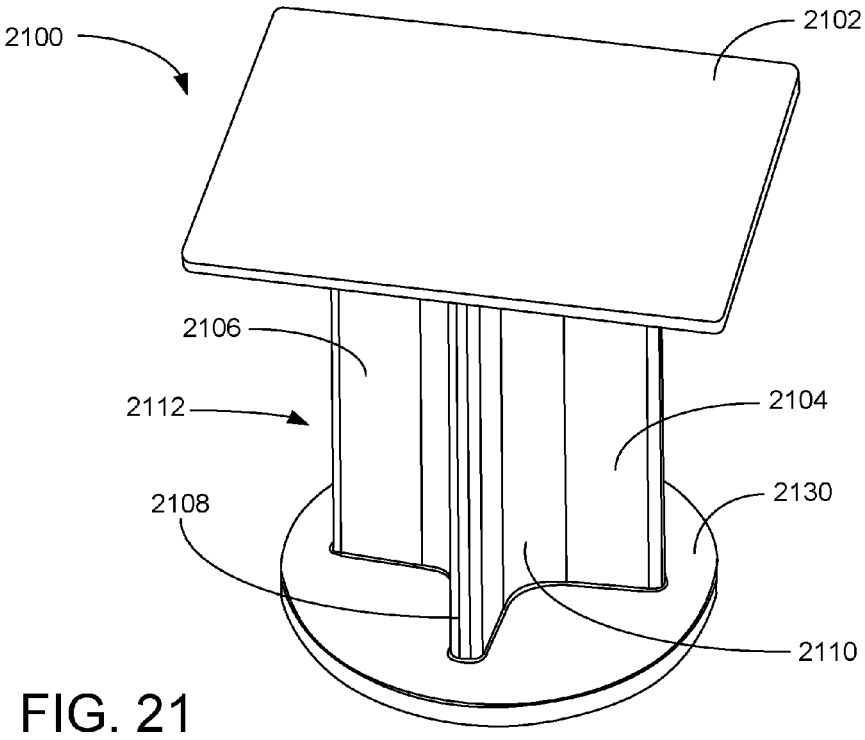
FIG. 21 is a top-side perspective view illustrating an exemplary support of a sixth exemplary embodiment of the short game golf trainer system of FIG. 34, according to a preferred embodiment of the present invention.
Figure 34:
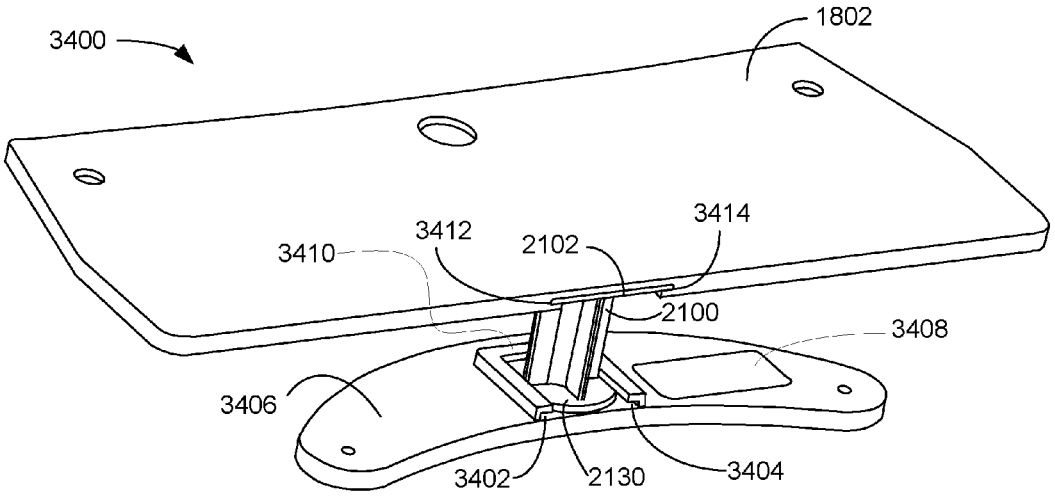
FIG. 34 is a top front perspective view illustrating an exemplary sixth exemplary embodiment of a short game golf trainer system, according to a preferred embodiment of the present invention.

FIG. 21 is a top-side perspective view illustrating an exemplary support 2100 of a sixth exemplary embodiment of the short game golf trainer system 3400 of FIG. 34, according to a preferred embodiment of the present invention. As mentioned above, any variations in size and shape for support 106 that meet the functional requirements of providing support, releasably coupling to the base 104, and releasably coupling to the top panel 102, are within the scope of the invention. Preferably, support 2100 is a single molded plastic piece. Top support plate 2102 is similar in dimensions to top support plate 702. The support pillar 2112 has four wings 2104, 2106, 2108, and one not visible in this view, with filets 2110 (one of two visible labeled) between wings 2104, 2106, 2108, and one not visible in this view. Bottom support plate 2130 is disc-shaped and sized to engage slots such as slots 1102 and 1104 (see FIG. 11). In various embodiments, support 2100 may be made in various heights and of various materials.

Figure 22:
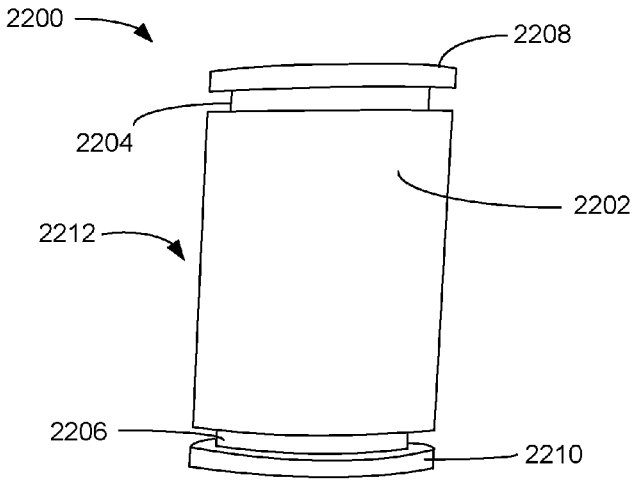
FIG. 22 is a top-side perspective view illustrating an exemplary support of a fifth exemplary embodiment of a short game golf trainer system, according to a preferred embodiment of the present invention.

FIG. 22 is a top-side perspective view illustrating an exemplary support 2212 of a fifth exemplary embodiment of a short game golf trainer system 2200, according to a preferred embodiment of the present invention. Short game golf trainer system 2200 includes a kit including at least one support 2212, top panel 2502, base 2900, and shorter top panel 3102 (see FIGS. 22-25 and 27-33). Short game golf trainer system 2200 is preferably made from milled plastic stock. As mentioned above, any variations in size and shape for support 106 that meet the functional requirements of providing support, releasably coupling to the base 104, and releasably coupling to the top panel 102, are within the scope of the invention. Support 2212 is a solid plastic cylinder 2202, preferably milled from plastic stock, with a top perimeter groove 2204 and a bottom perimeter grove 2206 in the cylinder 2202, thereby creating top support plate 2208 and bottom support plate 2210. Top support plate 2208 is shaped and sized to engage slots such as slots 2504 and 2506 (see FIG. 25). Bottom support plate 2210 is shaped and sized to engage slots such as slots 2916 and 2918 in base 2904 (see FIG. 29). In an additional embodiment, cylinder 2202 may be a cylindrical shell. Support 2212 is preferably made of plastic, but other materials may be used in additional embodiments.

Figure 23:
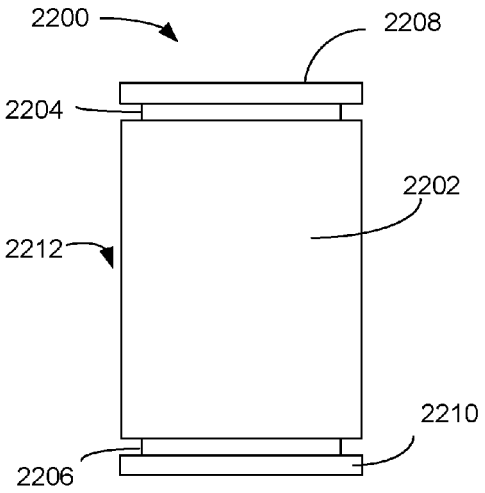
FIG. 23 is a top-side perspective view illustrating the exemplary support of the fifth exemplary embodiment of a short game golf trainer system of FIG. 22, according to a preferred embodiment of the present invention.

FIG. 23 is a top-side perspective view illustrating the exemplary support 2212 of the fifth exemplary embodiment of a short game golf trainer system 2200 of FIG. 22, according to a preferred embodiment of the present invention. Supports 2212 may have a first length for use with the top plate 2802 of short game golf trainer system 2200 (see FIG. 28) and a second length for use with shorter top plate 3102 (see FIG. 31 or FIG. 17) of the short game golf trainer system 2200.

Figure 24:
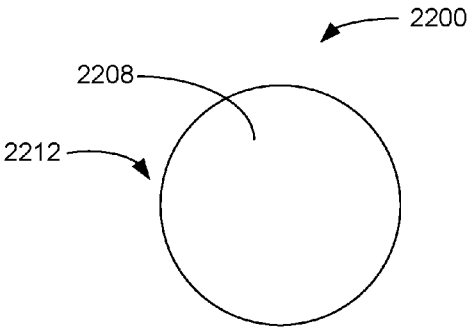
FIG. 24 is a top plan view illustrating the exemplary support of the fifth exemplary embodiment of the short game golf trainer system of FIG. 22, according to a preferred embodiment of the present invention.

FIG. 24 is a top plan view illustrating the exemplary support 2212 of the fifth exemplary embodiment of the short game golf trainer system 2200 of FIG. 22, according to a preferred embodiment of the present invention. While a circular cross-section is preferred, as shown, other cross sectional shapes may be used in additional embodiments. For example, a hexagonal cross section may be used.

Figure 25:
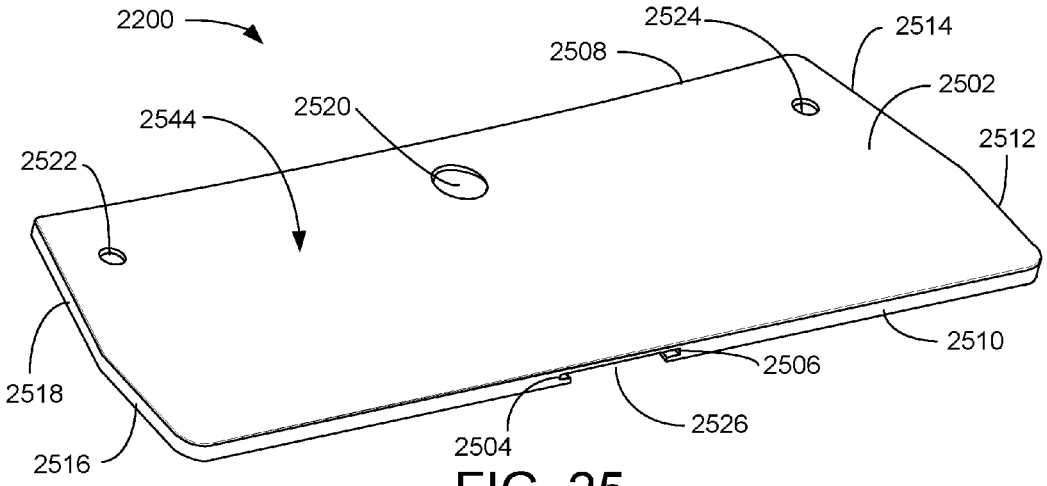
FIG. 25 is a top-front perspective view illustrating an exemplary top panel of the fifth exemplary embodiment of a short game golf trainer system of FIG. 22, according to a preferred embodiment of the present invention.

FIG. 25 is a top-front perspective view illustrating an exemplary top panel 2502 of the fifth exemplary embodiment of a short game golf trainer system 2200 of FIG. 22, according to a preferred embodiment of the present invention. Top panel 2502 is milled from plastic stock and has a viewing port 2520 and two golf ball holders 2522 and 2524, all aligned by their centers in the direction of an intended putt. Front side 2508 is concavely arcuate and all corners and top edges are rounded. Releasable coupling portion 2526 in rear side 2510 has slots 2504 and 2506 for receiving top support plate 2208 or other top support plate embodiment. Top surface 2544 is preferably black and diffusely reflective. Front left side 2518 has the same angle $\alpha$ to rear left side 2516 as in FIG. 15. Front right side 2514 has the same angle $\alpha$ to rear right side 2512 as in FIG. 15.

Figure 26:
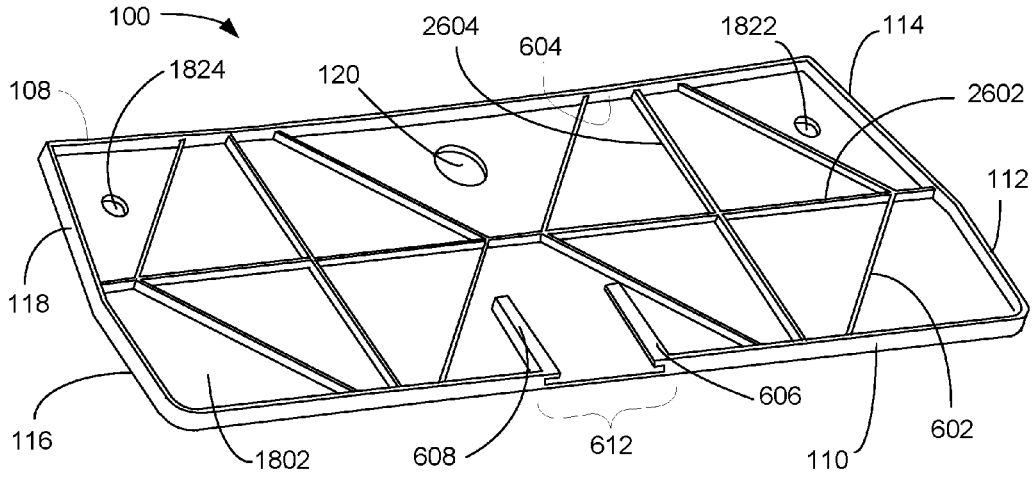
FIG. 26 is a bottom-rear perspective view illustrating the exemplary top panel of the third exemplary embodiment of a short game golf trainer system of FIG. 18, according to a preferred embodiment of the present invention.

FIG. 26 is a bottom-rear perspective view illustrating the exemplary top panel 1802 of the third exemplary embodiment of a short game golf trainer system 1800 of FIG. 18, according to a preferred embodiment of the present invention. Semi-perimeter ribbing 604 extends along left rear side 116, left front side 118, front side 108, right front side 114, left rear side 112, and most of rear side 110. Lateral rib 2602 extends between portions of semi-perimeter ribbing 604 on the left front side 118 and on the right front side 114. Transverse ribs 2604 (one of two labeled) extend between portions of semi-perimeter ribbing 604 on the front side 108 and the rear side 110. Diagonal ribs 602 (one of eight labeled) extend between portions of semi-perimeter ribbing 604 and the lateral rib 2602. The ribbing 2602, 2604, 2606, and 604 is merely exemplary. Various other ribbing schemes may be used in various other embodiments.

Figure 27:
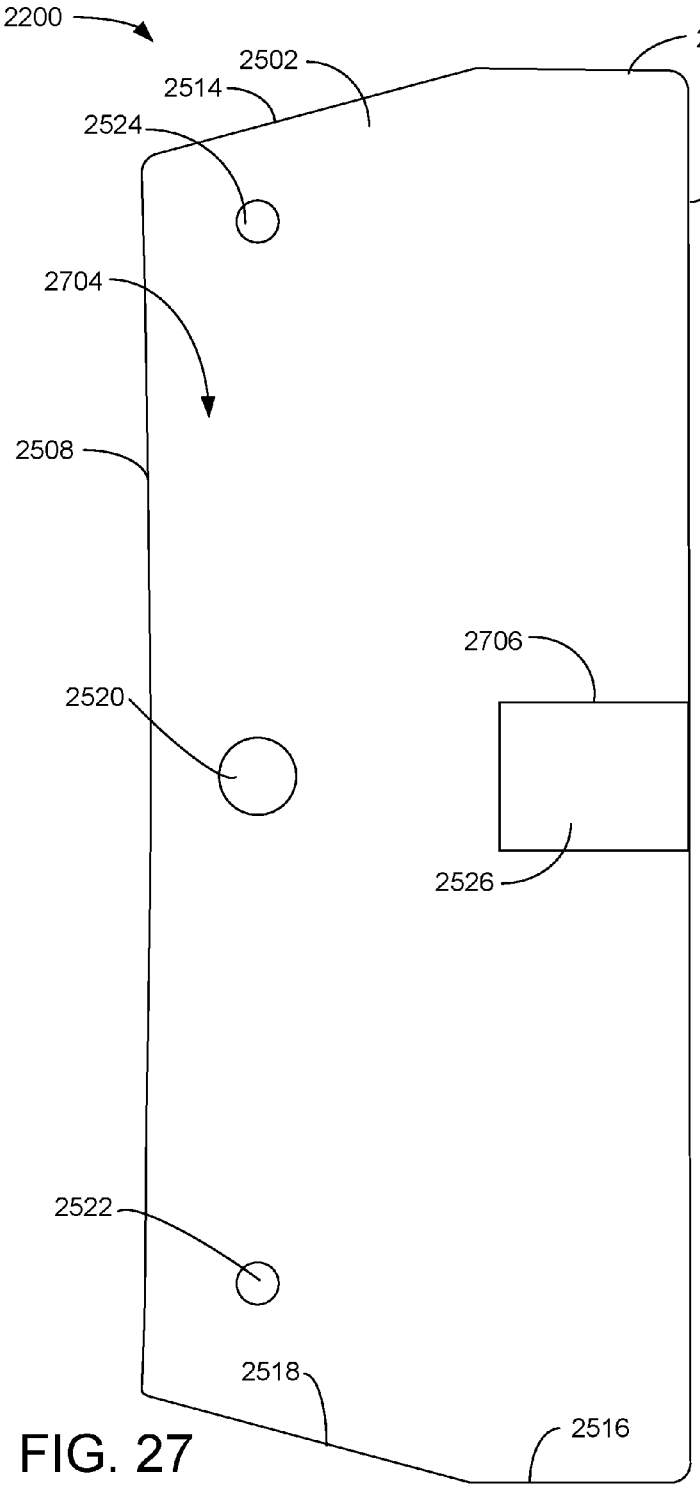
FIG. 27 is a bottom plan view illustrating the exemplary top panel of the fifth exemplary embodiment of a short game golf trainer system of FIG. 22, according to a preferred embodiment of the present invention.

FIG. 27 is a bottom plan view illustrating the exemplary top panel 2502 of the fifth exemplary embodiment of a short game golf trainer system 2200 of FIG. 22, according to a preferred embodiment of the present invention. Top panel 2502 has a plain bottom surface 2704 and a channel 2706 milled to provide releasable coupling portion 2526. In this embodiment, short game golf trainer system top panel 2502 is preferably made of a single solid piece of molded plastic with golf ball holders 2522 and 2524, viewing port 2520, cutout 2702, and releasable coupling portion 2526 with slots 2504 and 2506 milled into the piece. In an additional embodiment, top panel 2502 may be molded with some features 2520, 2522, and 2524 and then milled to form releasable coupling portion 2526.

Figure 28:
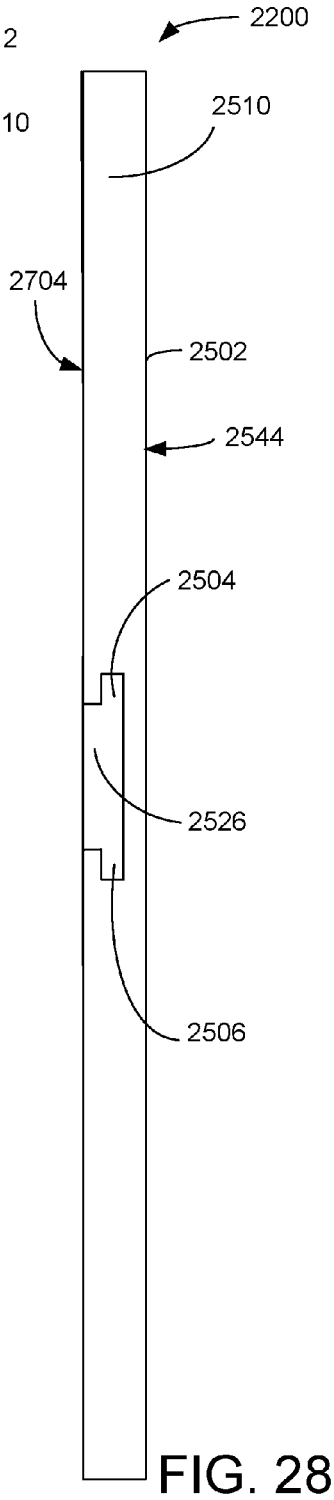
FIG. 28 is a rear plan view illustrating the exemplary top panel of the fifth exemplary embodiment of a short game golf trainer system of FIG. 22, according to a preferred embodiment of the present invention.

FIG. 28 is a rear plan view illustrating exemplary top panel 2502 fifth exemplary embodiment of a short game golf trainer system 2200 of FIG. 22, according to a preferred embodiment of the present invention. Slots 2504 and 2406 of releasable coupling portion 2526 can be clearly seen.

Figure 29:
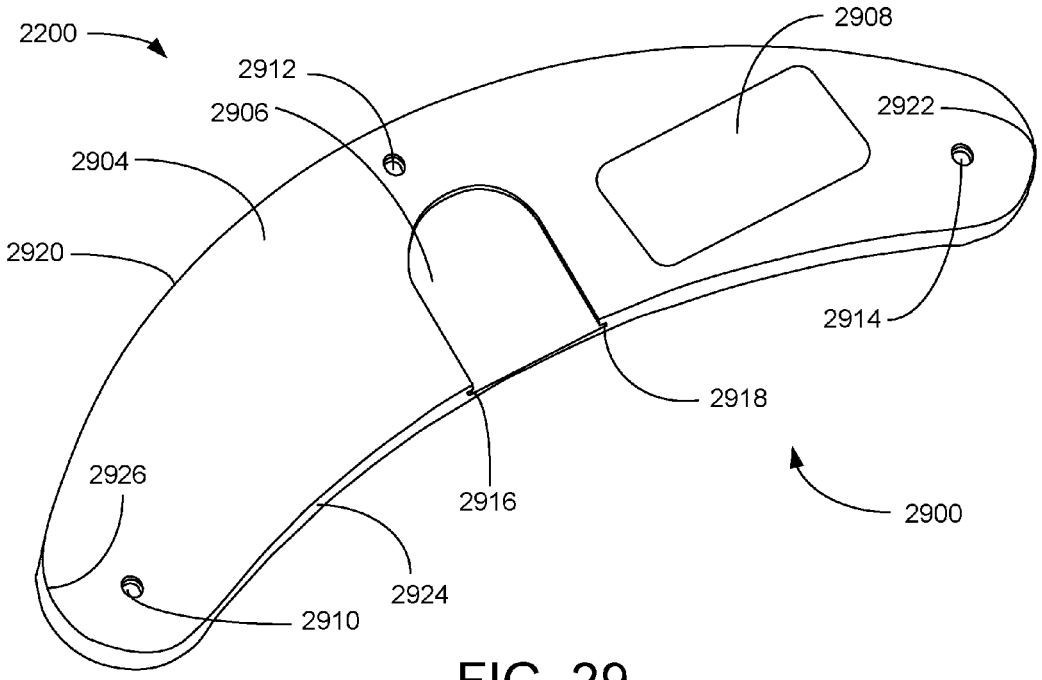
FIG. 29 is a top-front perspective view illustrating an exemplary base of the fifth exemplary embodiment of the short game golf trainer system of FIG. 22, according to a preferred embodiment of the present invention.

FIG. 29 is a top-front perspective view illustrating an exemplary base 2900 of the fifth exemplary embodiment of the short game golf trainer system 2200 of FIG. 22, according to a preferred embodiment of the present invention. Base 2900 includes a flat plate 2904 milled to have an arcuate rear side 2924, an arcuate front side 2920, and semicircular ends 2926 and 2922. Anchoring features 2910, 2912, and 2914 are exemplified here as holes though which elongated objects, such as golf tees or nails, can be inserted into a golf green, fairway, or rough. Releasable coupling portion 2906, which is milled in, includes slots 2916 and 2918, for receiving bottom support plates 130, 2130, 2210, or other embodiments. In various embodiments, label area 2908 may have milled-in designs, logos, and text naming and/or trade marking the product. In other embodiments, label area 2908 may have a smooth flat surface for receiving printed or painted designs, logos, and text.

Figure 30:
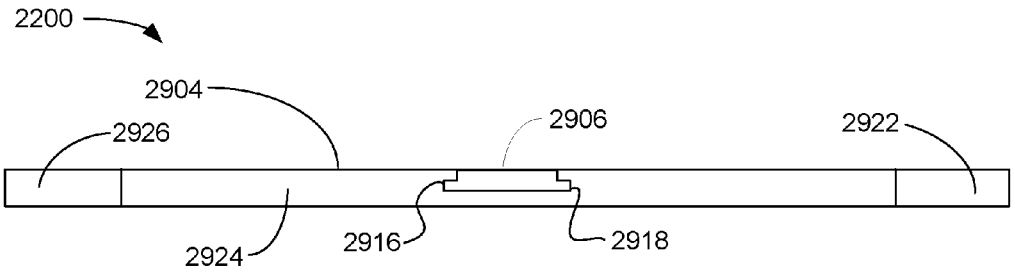
FIG. 30 is a rear side elevation view illustrating the exemplary base of the fifth exemplary embodiment of the short game golf trainer system of FIG. 22, according to a preferred embodiment of the present invention.

FIG. 30 is a rear side elevation view illustrating the exemplary base 2900 of the fifth exemplary embodiment of a short game golf trainer system 2200 of FIG. 22, according to a preferred embodiment of the present invention. Slots 2916 and 2918 of releasable coupling portion 2906 can be clearly seen. Releasable coupling portion 2906 and bottom support plate 2210, when fit together, form a releasable coupling.

Figure 31:
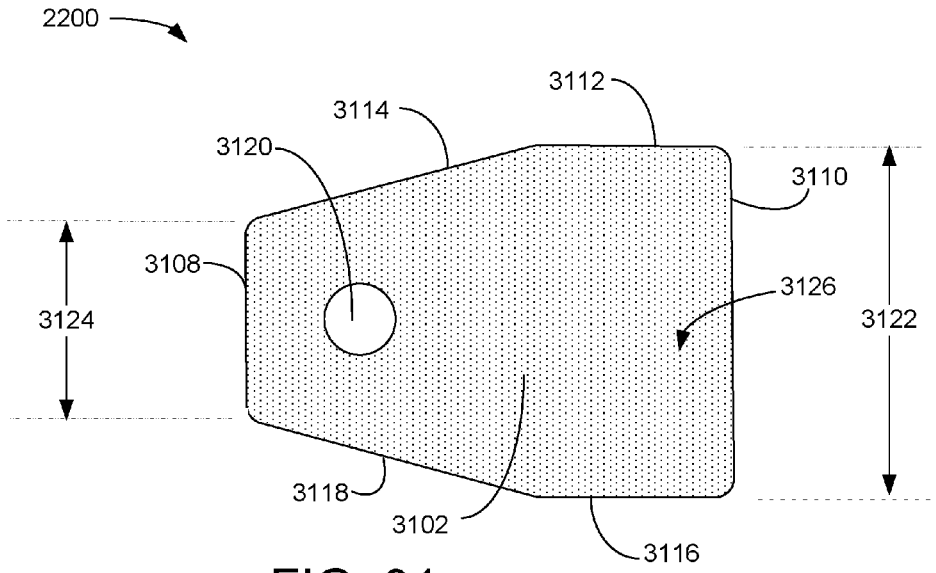
FIG. 31 is a top plan view illustrating an exemplary shorter top panel of the fifth exemplary embodiment of the short game golf trainer system of FIG. 22, according to a preferred embodiment of the present invention.

FIG. 31 is a top plan view illustrating an exemplary shorter top panel 3102 of the fifth exemplary embodiment of the short game golf trainer system 2200 of FIG. 22, according to a preferred embodiment of the present invention. The shorter top panel 3102 is used with a support 106, 2100, or preferably 2212, or any of the un-illustrated embodiments of a support; and base 104, 1704, or preferably 2900, or un-illustrated embodiments of a base. Top panel 3102 is similar to top panel 1702 in size and dimension, but features a diffusely reflective top surface 3122 and rounded corners. Rear side 3110 as a length approximately one-fifth of the length 204 of top panel 102. Front side 3108 has a length 3124 that is greater than a golf ball diameter. Top panel 3102 has a viewing port 3120, spaced apart and centered more than one half of a golf ball diameter from front side 3108, for viewing a portion 1612 of a golf ball 1604, a rear side 3110, left and right rear side sides 3112 and 3116 extending forward at right angles from rear side 3110, and left and right forward side sides 3114 and 3118 extending at an angle from left and right rear side sides 3112 and 3116, respectively, to meet front side 3108. Shorter top plate 3102 is preferably made of one piece of milled plastic stock.

Figure 32:
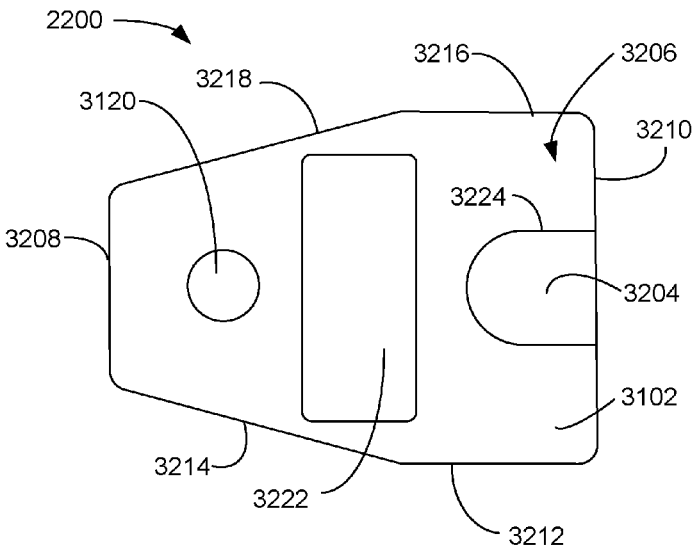
FIG. 32 is a bottom plan view illustrating an exemplary shorter top panel of the fifth exemplary embodiment of the short game golf trainer system of FIG. 22, according to a preferred embodiment of the present invention.

FIG. 32 is a bottom plan view illustrating an exemplary shorter top panel 3102 of the fifth exemplary embodiment of the short game golf trainer system 2200 of FIG. 22, according to a preferred embodiment of the present invention. Bottom surface 3206 has a milled out portion 3224 creating a releasable coupling portion 3204. Bottom surface 3206 has a plain surface 3206 and a label area 3222. In various embodiments, label area 3222 may have milled-in designs, logos, and text naming and/or trade marking the product. In other embodiments, label area 3222 may have a smooth flat surface for receiving printed or painted designs, logos, and text. In various embodiments, various shapes of label area 3222 may be used.

Figure 33:
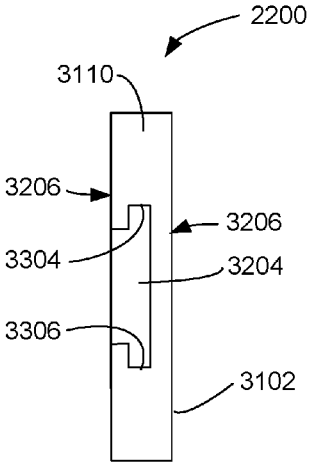
FIG. 33 is a rear plan view illustrating the exemplary shorter top panel of the fifth exemplary embodiment of the short game golf trainer system of FIG. 22, according to a preferred embodiment of the present invention.

FIG. 33 is a rear plan view illustrating the exemplary shorter top panel 3102 of the fifth exemplary embodiment of a short game golf trainer system 2200 of FIG. 22, according to a preferred embodiment of the present invention. Releasable coupling portion 3204 in top panel 3102 has slots 3304 and 3306 for receiving top support panel 2208 or other top support plate embodiment.

FIG. 34 is a top front perspective view illustrating an exemplary sixth exemplary embodiment of a short game golf trainer system 3400, according to a preferred embodiment of the present invention. Base 3406 is releasably coupled to support 2100 which is releasably coupled to top panel 1802. Circular bottom support plate 2130 fits within slots 3402 and 3404 of releasable coupling portion 3410 and is secured by friction. Top support plate 2102 (see FIG. 21) fits within slots 3412 and 3414 and is secured by friction. Supports 106, 2100, and 2212 are preferably interchangeable. Top panels 102, 1802, 2502, and 3102 are preferably interchangeable. Bases 104, 2904, and 3606 are preferably interchangeable A preferred kit for sale to consumers includes base 2904; first and second supports 2212, each of a different height; top panel 2802 and top panel 3102. Those of skill in the art, enlightened by the present disclosure, will appreciate that, the higher the support 2212, the smaller the viewing port 2520 or 3120 must be to maintain the same area of observation 1612 as shown in FIG. 16. Generally, a chipping and pitching support 2212 will be taller than the putting support 2212, to accommodate the more arcuate swing of the golf club.

Figure 35:
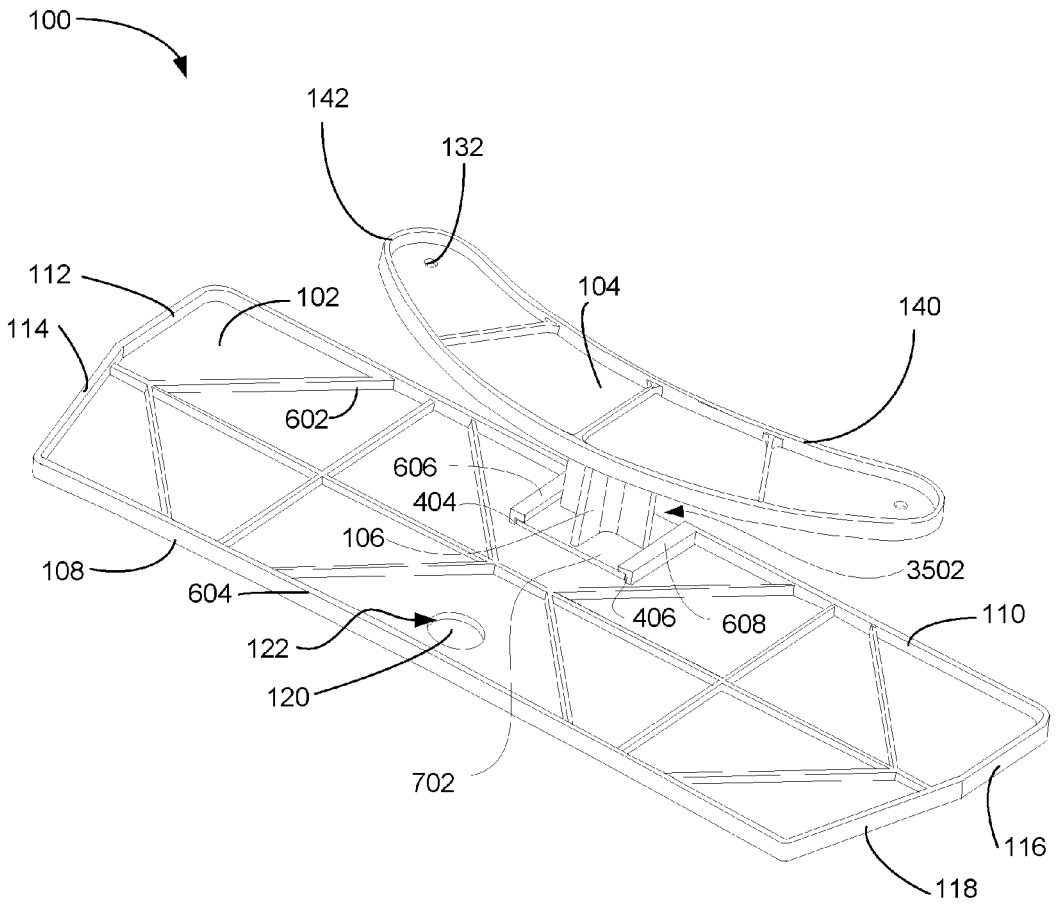
FIG. 35 is a bottom front perspective view illustrating the exemplary embodiment of the short game golf trainer system of FIG. 1, according to a preferred embodiment of the present invention.

FIG. 35 is a bottom front perspective view illustrating the exemplary embodiment of the short game golf trainer system 100 of FIG. 1, according to a preferred embodiment of the present invention. FIG. 35 mire clearly shows the second releasable coupling portion 3502 (portion of the short game golf trainer system 100 coupling support 106 to top panel 108) that include a first portion 612 (first portion of the coupling including channels 606 and 608) of the second releasable coupling portion 3502 and a second portion 702 (second portion of the coupling including rectangular top support plate 702) of the second releasable coupling portion 3502. The principle of operation of the second releasable coupling portion 3502 may, in some embodiments, be the same as for the first releasable coupling portion 146 (coupling the support 106 to base 104) that includes a first portion of the first releasable coupling portion 146 (channels 126 and 128) extending from the base 104 and a second portion (base support plate 130) of the first releasable coupling portion 146 extending from the support 106.

I claim:

1. A short game golf trainer system comprising:
a. a base;
b. a releasable support adapted to extend from said base;
c. a releasable top plate adapted to extend cantilevered from a distal end of said support and having a front side distal from said support; and
d. a viewing port in said top plate that:
i. is distal from said support;
ii. is laterally centered on said top plate;
iii. has a center that is spaced apart from said front side by more than one-half the width of a golf ball; and
iv. has a diameter that is less than the diameter of such golf ball.

2. The short game golf trainer system of claim 1, comprising a first releasable coupling between said base and said support.

3. The short game golf trainer system of claim 1, comprising a second releasable coupling between said support and said top plate.

4. The short game golf trainer system of claim 1, wherein said top plate comprises;
a. an irregular hexagonal shape; and
b. a first portion of a second releasable coupling.

5. The short game golf trainer system of claim 1, comprising visible alignment features that are:
a. on said cantilevered top plate or in said cantilevered top plate; and
b. aligned parallel to a rear side of said top plate on a centerline through said viewing port.

6. The short game golf trainer system of claim 5, wherein said alignment features comprise at least one of:
a. a plurality of arrow-shaped designs on a top surface of said cantilevered top plate; and
b. a plurality of golf ball sockets formed in said cantilevered top plate.

7. The short game golf trainer system of claim 1, wherein said base comprises a flat plate having a plurality of anchoring features.

8. The short game golf trainer system of claim 7 wherein said base comprises:
a. an arcuate front side;
b. an arcuate rear side;
c. first and second opposed semicircular ends continuous with said arcuate front side and said arcuate rear side; and
d. a first portion of a first releasable coupling on a top surface of said base.

9. The short game golf trainer system of claim 1, wherein said support comprises:
a. a bottom support plate adapted to be a second portion of a first releasable coupling;
b. a pillar extending from said bottom support plate; and
c. a top support plate extending from a distal end of said pillar and adapted to be a second portion of a second releasable coupling.

10. The short game golf trainer system of claim 9, wherein said support comprises one piece of molded plastic.

11. The short game golf trainer system of claim 10, wherein said support comprises one of:
a. said pillar having a cylindrical outer surface and said top and bottom support plates each having a circular perimeter;
b. said pillar having a plurality of axially aligned, radially extending wings having curved portions between said wings and said top and bottom support plates each having a rectangular or a curved perimeter; and
c. said pillar having a plurality of axially aligned, radially extending wings having no curved portions between said wings and having said top and bottom support plates each having a rectangular or a curved perimeter.

12. The short game golf trainer system of claim 1, comprising a short game golf trainer system kit, further comprising:
a. said base;
b. a first said support having a first height;
c. a second said support having a second height that is not said first height;
d. a first said top plate having a first length;
e. a second said top plate having a second length that is not said first length.

13. A short game golf trainer system comprising:
a. a base;
b. a releasable support adapted to extend from said base;
c. a releasable top plate:
i. adapted to extend cantilevered from a distal end of said support; and
ii. having five straight sides and an arcuate front side distal from said support; and
d. a viewing port in said cantilevered top plate that:
i. is circular;
ii. is distal from said support;
iii. is laterally centered on said top plate;
iv. has a center that is spaced apart from said arcuate front side by more than one-half the width of a golf ball; and
v. has a diameter that is less than the diameter of such golf ball.

14. The short game golf trainer system of claim 13, comprising:
a. a first releasable coupling between said base and said support; and
b. a second releasable coupling between said support and said top plate.

15. The short game golf trainer system of claim 14, wherein said top plate comprises;
a. a first portion of said second releasable coupling; and
b. visible alignment features that are:
i. on said cantilevered top plate or in said cantilevered top plate; and
ii. aligned parallel to a rear side of said top plate on a centerline through said viewing port.

16. The short game golf trainer system of claim 15, wherein said alignment features comprise at least one of:
a. a plurality of arrow-shaped designs on a top surface of said cantilevered top plate; and
b. a plurality of golf ball sockets formed in said cantilevered top plate.

17. The short game golf trainer system of claim 14, wherein said base comprises:
a. a flat plate having a plurality of anchoring features;
b. an arcuate front side;
c. an arcuate rear side;
d. first and second opposed semicircular ends each continuous with said arcuate front side and said arcuate rear side; and
e. a first portion of said first releasable coupling on a top surface of said base.

18. The short game golf trainer system of claim 13, wherein said support comprises:
a. a second portion of a first releasable coupling comprising a bottom support plate extending from a pillar;
b. said pillar extending between said bottom support plate and a top support plate; and c. a second portion of a first releasable coupling, further comprising said top support plate extending from said pillar;

d. wherein said pillar, said top support plate, and said bottom support plate comprise one piece of molded plastic; and e. wherein said support comprises one of:

i. said pillar having a cylindrical outer surface and said top and bottom support plates each having a circular perimeter;

ii. said pillar having a plurality of axially aligned, radially extending wings having curved portions between said wings and said top and bottom support plates each having a rectangular or a curved perimeter; and iii. said pillar having a plurality of axially aligned, radially extending wings having no curved portions between said wings and having said top and bottom support plates each having a rectangular or a curved perimeter.

19. A short game golf trainer system apparatus comprising:

a. a base, further comprising:

i. a flat plate having a plurality of an anchoring features;

ii. an arcuate front side;

iii. an arcuate rear side;

iv. first and second opposed semicircular ends each continuous with said arcuate front side and said arcuate rear side; and v. a first portion of a first releasable coupling on a top surface of said base;

b. a releasable support adapted to extend from said base, and further comprising:

i. a second portion of said first releasable coupling comprising a bottom support plate extending from a pillar;

ii. said pillar extending between said bottom support plate and said top support plate;

iii. a second portion of a second releasable coupling, further comprising said top support plate extending from said pillar; and iv. wherein said pillar, said top support plate, and said bottom support plate comprise one piece of molded plastic; and c. a releasable top plate:

i. adapted to extend cantilevered from said support;

ii. having five straight sides and an arcuate front side distal from said support;

iii. having a first portion of said second releasable coupling;

iv. having a viewing port in said cantilevered top plate that:

1. is circular;

2. is distal from said support;

3. is laterally centered on said top plate;

4. has a center that is spaced apart from said arcuate front side by more than one-half the width of a golf ball; and 5. has a diameter that is less than the diameter of such golf ball;

v. having visible alignment features that are:

1. on said cantilevered top plate or in said cantilevered top plate; and 2. aligned parallel to a rear side of said top plate on a centerline through said viewing port.

20. The short game golf trainer system of claim 19, comprising a short game golf trainer system kit, further comprising:

a. said base;

b. a first said support having a first height;

c. a second said support having a second height that is not said first height;

d. a first said top plate having a first length;

e. a second said top plate having a second length that is not said first length.

* * * * *